United States Patent [19]

Chowning

[11] 4,018,121

[45] Apr. 19, 1977

[54] METHOD OF SYNTHESIZING A MUSICAL SOUND

[75] Inventor: John M. Chowning, Palo Alto, Calif.

[73] Assignee: The Board of Trustees of Leland Stanford Junior University, Stanford, Calif.

[22] Filed: May 2, 1975

[21] Appl. No.: 573,933

Related U.S. Application Data

[63] Continuation-in-part of Ser. No. 454,790, March 26, 1974, abandoned.

[52] U.S. Cl. ..... 84/1.01; 84/101

[51] Int. Cl.[2] ..... G10H 1/00; G10H 5/00

[58] Field of Search ..... 84/1.01, 1.24, 1.25

[56] References Cited

UNITED STATES PATENTS 3,794,748 2/1974 Deutsch ..... 84/1.24

OTHER PUBLICATIONS

Alan Douglas, "Electrical Synthesis of Musical Tones", Electronic Engineering, July 1953, p. 278.

Alley & Atwood, Electronic Engineering, Second Edition, John Wiley & Sons, Inc., copyright 1966, pp. 564–572.

*Primary Examiner*—Stanley J. Witkowski

*Attorney, Agent, or Firm*—Flehr, Hohbach, Test, Albritton & Herbert

[57] ABSTRACT

Musical sounds are synthesized by means of frequency modulation with the carrier and modulating frequencies being in the audio range and the modulating index being related to a function to control the bandwidth and evolution in time of the partial frequencies of synthesized sound.

14 Claims, 18 Drawing Figures

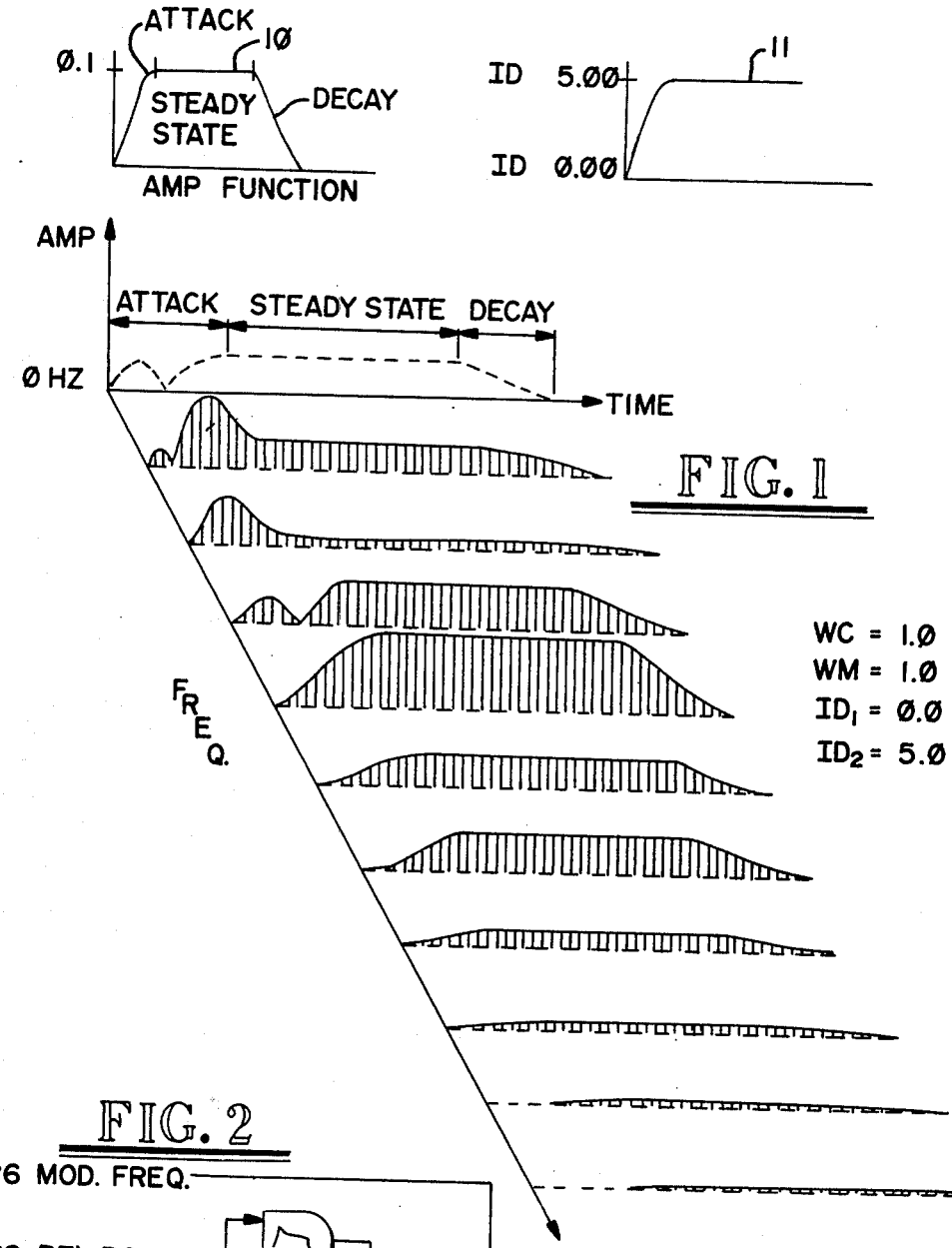
FIG. 1
FIG. 2
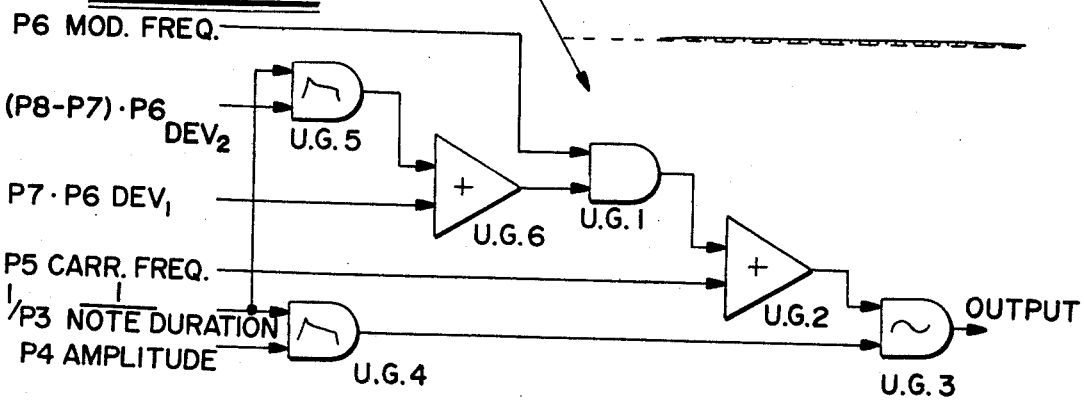

WC = 1.Ø
WM = 2.Ø
IDX1 = 2.Ø
IDX2 = 1.Ø

THE PROGRAM FOR THESE TWO ROMS IS THE "SIN TABLE" PROGRAM

METHOD OF SYNTHESIZING A MUSICAL SOUND

CROSS REFERENCE TO RELATED APPLICATION

This application is a continuation-in-part of application Ser. No. 454,790, filed Mar. 26, 1974, and now abandoned.

BACKGROUND OF THE INVENTION

The present invention is directed to a method of synthesizing a musical sound and more specifically to a technique utilizing frequency modulation to provide for the temporal evolution of the spectral components of a musical sound.

Several types of musical synthesizers are well known in the art but thus far the synthesis of natural sounds has been elusive. In a typical type of analog synthesizer, a voltage controlled oscillator is driven by a waveform of the desired shape and frequency and then filtered and passed through an attenuator to provide the proper envelope to simulate a desired musical or natural sound. With the foregoing analog synthesizer which is of the subtractive type, there is, of course, no evolution in time of the various spectral components or partial frequencies of the final sound.

Synthesizers utilizing digital techniques have realized that to create a natural sound individual partial frequencies must be generated and combined. One type of organ is based on this principle where the several partial frequencies are added together and then given a common envelope function. The combinations of such frequencies are based, of course, on the principles established in Fourier analysis.

Yet another digital synthesis technique has been suggested by Jean-Claude Risset and Max V. Mathews, "Analysis of Musical Instrument Tones," *Physics Today, vol.* 22, no. 2, pp. 23–30 (1969). Risset established that the character of the temporal evolution or the evolution in time of the spectral components of a sound is of critical importance in the determination of timbre. In other words, Risset would suggest that to simulate a natural sound the amplitude of each harmonic should be individually controlled as a function of time. In addition, Risset suggested, at least for the production of the trumpet tones, that the attack envelope, that is, the initial envelope characteristic for the trumpet tone, has a distinctive characteristic in that during the attack and also decay portion of the sound, the energy of the various frequency components evolve in complicated ways.

To implement the Risset theory with known techniques requires a complex digital computer which individually simulates each frequency component. Thus, at the present time a real time music synthesizer of the digital type is not commercially feasible.

The variation of bandwidth with modulation index has been illustrated in an article by Murlan S. Corrington, "Variation of Bandwidth With Modulation Index in Frequency Modulation," Selected Papers on Frequency Modulation, edited by Klapper (Dover Publications, 1970). However, this is merely a theoretical study of frequency modulation.

OBJECTS AND SUMMARY OF THE INVENTION

It is, therefore, an object of the present invention to provide an improved method of synthesizing a musical sound composed of a plurality of partial frequencies in which the amplitude of each frequency individually varies as a function of time in accordance the timbral qualities of the musical sound to be synthesized.

In accordance with the above object, the method comprises the steps of selecting carrier, $\omega_c$, and modulation, $\omega_m$, frequencies in the audio range. The $\omega_c$ and $\omega_m$ frequencies are modulated in accordance with $$e = A_{sin}[\omega_c t + I(t) \sin \omega_m t]$$

where $e$ is the instantaneous amplitude of the frequency modulated wave, $A$ is the peak amplitude and $I(t)$ is the modulation index. $I(t)$ is selected as a predetermined function to control the bandwidth of the wave and its evolution in time.

BRIEF DESCRIPTION OF THE DRAWINGS

FIG. 1 is a dynamic FM spectrum useful in understanding the invention;

FIG. 2 is a circuit useful for practicing the present invention as represented in MUSIC V notation;

DETAILED DESCRIPTION OF THE PREFERRED EMBODIMENTS

Figure 3:
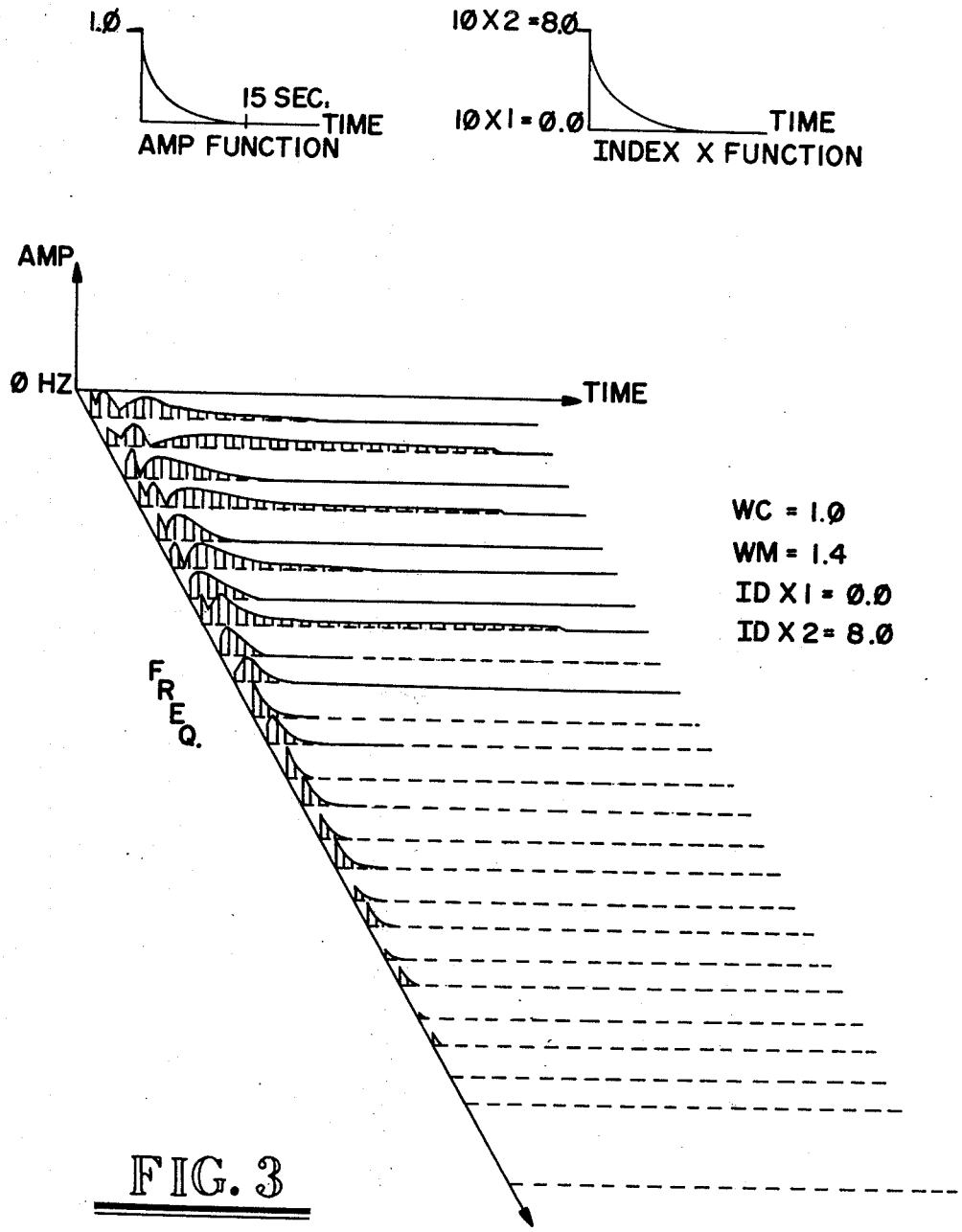
FIGS. 3 and 4 are dynamic FM spectra useful in understanding the invention.

In general the present invention provides a frequency modulation technique for producing a complex spectra; that is, one which has a spectral evolution which evolves in time with relative simplicity. In other words, the frequency modulation technique of the present invention provides for specific control of the individual or partial frequencies making up a total or natural musical sound.

Specifically, this is accomplished by selecting carrier and modulation frequencies in the audio range and frequency modulating the carrier $\omega_c$ with the modulation frequency, $\omega_m$, in accordance with $$e = A_{sin}\ [\omega_c t + I(t) \sin \omega_m t] \qquad (1)$$

where $e$ is the instantaneous amplitude of the frequency modulated wave, $A$ is the peak amplitude and $I(t)$ the modulation index. Moreover, the modulation index is selected as a predetermined function to control the bandwidth of the wave and its evolution in time.

FIG. 1 illustrates the foregoing for the production of a brass-like sound. The dynamic spectra of a typical brass tone is shown as functions of frequency, time and amplitude in the Attack mode to steady state mode and into a Decay mode. The curve 10 labeled amplitude function is a characteristic envelope function of the overall tone or musical sound and varies the factor A in equation (1). Curve 11 labeled index function shows the variation of $I(t)$ from an initial zero point $ID_1$ to the final steady state point $ID_2$. The spectral evolution curves of FIG. 1 are based on carrier and modulation frequencies equal to one another. That is, they have relative values of 1.0 as indicated in the drawing of FIG. 1 with $ID_1$ equal to zero and $ID_2$ equal to five. The overall envelope of amplitude function 10 in essence varies the peak amplitude A of equation (1). Thus, the intensity of sound increases from a zero level as shown by curve 10 to a maximum at steady state and then decays in a somewhat linear manner.

Risset demonstrated in his analysis of trumpet tones a fundamental characteristic of this class of timbres; the amount of energy in the spectrum is distributed over an increasing band in approximate proportion to the increase in intensity. This is illustrated in FIG. 1 where initially only the carrier and lower harmonics such as the second and third have any appreciable amplitude and thereafter during the state state [designated SS] the higher harmonics are increased in intensity. Other characteristics of a brass tone are that frequencies in the spectrum are in harmonic series, both odd and even numbered harmonics are sometimes present, and as stated by Risset but not specifically illustrated in FIG. 1, the rise time of the amplitude or envelope function is rapid for a typical attack and may "overshoot" the steady state. Moreover, a comparison of the curves 10 and 11, illustrates that the modulation index varies in direct proportion to the amplitude of a modulated carrier wave.

The musical brass-like sound illustrated in FIG. 1 is preferably achieved by use of a special purpose computer or digital FM synthesizer as will be described below. However, for demonstration purposes as to the effectiveness of the concept of the present invention a typical minicomputer can be programmed with a FORTRAN IV program written in MUSIC V. MUSIC V is a well-known program as set out in a look by Max V. Mathews, *The Technology of Computer Music* (The MIT Press, Boston, 1969). The difficulty with using the MUSIC V program is that it is not a real-time on-line system.

In general, the MUSIC V sound synthesis program is a program which generates samples of a sound wave which are then stored in a memory device as computed. Digital to analog conversion and filtering then allows an audio system to regenerate the sound. The program is designed so that computation of samples is done by program blocks called unit generators abbreviated U.G. A typical unit generator is an oscillator which has two inputs, an output, and a stored wave shape function. The first input specifies the amplitude of the output, the second input the frequency of the output, and the function determines the shape of the output. The value of an input can either be specified by the user or can be the output of another unit generator, thereby allowing multi-level operations on waveforms. A collection of interconnected unit generators is called an instrument which is supplied data through a set of parameters $P_1$ through $P_8$.

Referring to FIG. 2, this is a suitable instrument for producing a FM circuit which generates a dynamic spectra in accordance with the present invention. A unit generator 4 produces an amplitude envelope similar to envelope 10 of FIG. 1 and a unit generator 5 a modulation index envelope similar to envelope 11 of FIG. 1. The parameters for the instruments have the following functions.

$P_1$ = Begin time of instrument
$P_2$ = Instrument number
$P_3$ = Duration of the "note"
$P_4$ = Amplitude of the output wave
$P_5$ = Carrier frequency
$P_6$ = Modulating frequency
$P_7$ = Initial modulation index $ID_1$
$P_8$ = Final modulation index $ID_2$ The parameter values for brass-like tones such as illustrated in FIG. 1 would be the following:

$P_3 = 0.6$
$P_4 = 1000$ (amplitude scaling)
$P_5 = 440$ Hz
$P_6 = 440$ Hz (ratio of c/m = 1/1)
$P_7 = 0$
$P_8 = 5$.

A standard MUSIC V program is suitable in many instances but depending on the musical sound being generated the instantaneous frequency of the modulated carrier at times become negative; in other words, the final waveform would have a phase angle which decreases with time. This condition occurs when either the ratio of the carrier to the modulating frequency is very small or the modulation index is very large. Thus, the unit generator U.G. 3 of FIG. 2 must be able to produce a wave which results from taking the sine of an angle which decreases as well as increases with time. The change in code to the oscillator in MUSIC V to allow for decreasing angle is:

for

```
290 IF(SUM -XNFUN) 288, 287, 287
287 SUM=SUM-XNFUN
```

substitute

```
290 IF(SUM.GW.XNFUN) GO TO 287
IF(SUM.LT.0.0) GO TO 289
```

and for

```
GO TO293
292 J6=L1+J3−1
```

substitute

```
GO TO 293
287 SUM=SUM−XNFUN
GO TO 288
289 SUM=SUM+XNFUN
GO TO 288
292 J6=L1+J3−1
```

Figure 4:
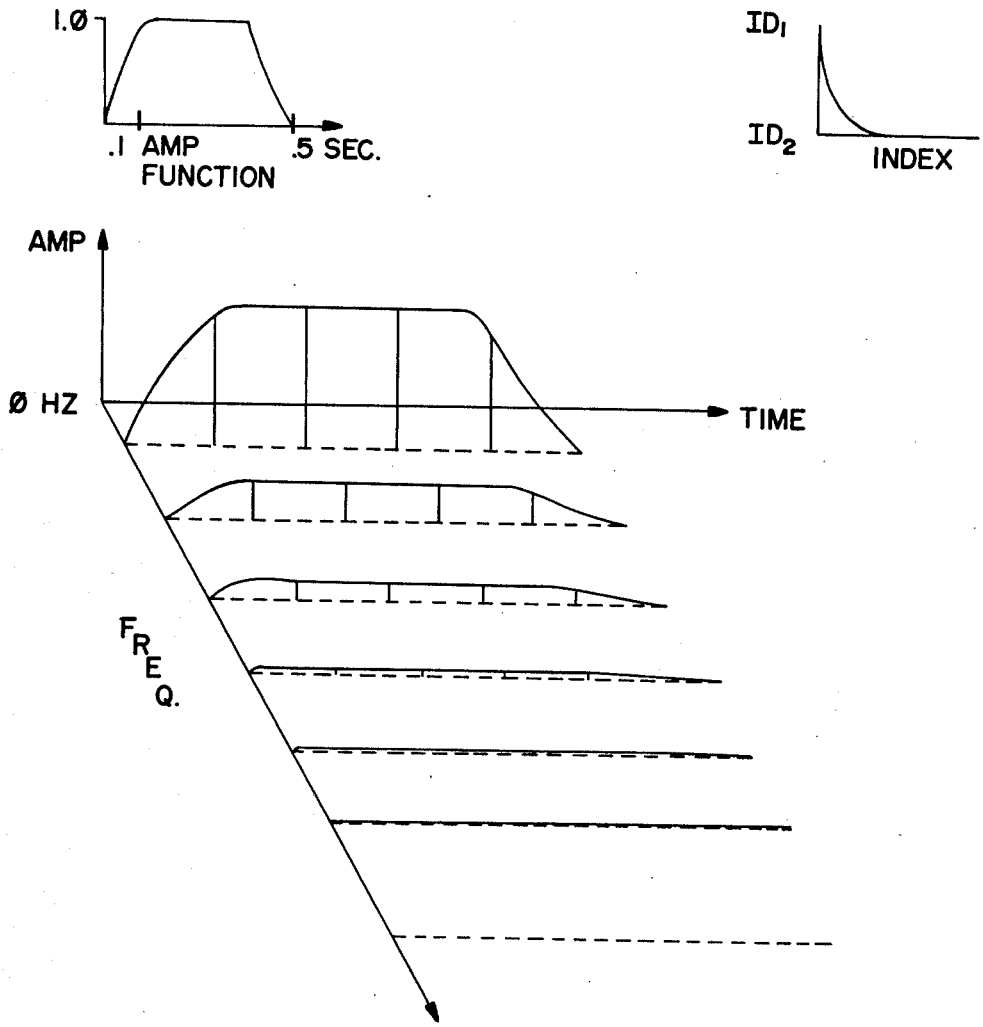

FIGS. 3 and 4 illustrate respectively bell-like and clarinet-like tones. Referring to FIG. 3, the bell-like timbre of the family of percussive sounds is developed around the following two premises:

1. The spectral components are not usually in the harmonic series, and

2. The evolution of the spectrum is from the complex to the simple. The amplitude or envelope function of the bell-like sound illustrated has an exponential decay which, for example, may terminate at a time of 15 seconds. The index function is directly proportional to the amplitude envelope. From a MUSIC V standpoint, the parameters to produce a bell-like sound can be the following:

$P_3 = 15$ seconds
$P_4 = 1000$
$P_5 = 200$ Hz
$P_6 = 280$ Hz
$P_7 = 0$
$P_8 = 10$.

More importantly, however, the carrier and moduation frequencies are related to one another by an irrational number or a number ratio which is not an integer. As illustrated in FIG. 3, this causes inharmonic spectra where the components are not in a relation of simple ratios. However, such irrational numbers should be small enough to maintain the density of partial tones to produce, for example, the bell-like sound of FIG. 3.

The irrational ratio of $\omega_c/\omega_m = 1/\sqrt{2}$, for example, which produces a nonperiodic waveform, and where the bandwidth is controlled by the index function in time, can produce bell tones and other percussive tones as shown in FIG. 3.

The same technique can also be used to produce secondary features of quasi-periodic tones, such as the "scratchiness" during the attack of a violin tone. This will be termed a "grit function" hereinafter. In this case, this index or grit function would only be non-zero during the attack interval of, for example, 0.025 seconds after which the spectrum would be composed solely of the rationally related $\omega_c/\omega_m$ ratios. This would demand two modulating oscillators and one carrier oscillator, where the first modulating frequency is related to the carrier, $\omega_c/\omega_m = 1/1$, and the second by $1/\sqrt{2} = \omega_c/\omega_m$. In such as case, the FM modulation of the present invention would occur in accordance with the following equation:

$$e = A_{sin}\,[\omega_c t + I_1(t)\sin\omega_{m1}t + I_2(t)\sin\omega_{m2}t] \qquad (2)$$

where $I_1(t)$ and $\omega_{m1}$ are equivalent to $I(t)$ and $\omega_m t$ of equation (1) and $\omega_{m2}$ is an additional modulating frequency where $\omega_c/\omega_{m2}$ is equal to an irrational number. Thus, the first index $I_1(t)$ would have an envelope shape similar to the amplitude envelope of the brass-like sound of FIG. 2 but in addition the grit function would be added and would be the predetermined function of the second index $I_2(t)$ and having a duration of less than 200 milliseconds. Thus, for a violin sound along with the grit function the carrier and first modulation frequency would be related by a function $1/1 = \omega_c/\omega_{m1}$. The first index function would be inversely proporational to the rising amplitude envelope.

From the foregoing it is apparent that the ratio of the carrier and modulating frequencies determines the position of the components in the spectrum. The modulation index itself determines the number of components which will have a significant amplitude. With regard to simple frequency ratios, $N_1/N_2$, the following generalizations can be made:

1. The carrier is always the $N_1$th harmonic in the series.
2. If $N_2 = 1$, the spectrum contains all harmonics and the fundamental is at the modulating frequency, e.g., 1/1,2/1.
3. When $N_2$ is an even number, the spectrum contains only odd numbered harmonics, e.g., ½, ¼, 3/2, ¾, 5/2.
4. If $N_2 = 3$, every third harmonic is missing from the series, e.g., ⅓, ⅔, 4/3, 5/3.

FIG. 4 illustrates a clarinet-like timbral sound where the index function curve is inversely proportional to the leading edge of amplitude function. In addition $\omega_c/\omega_m = ½$. This, as stated above in rule (3) produces only odd harmonics which is a well known characteristic of the clarinet sound.

With respect to the grit function $I_2(t)$ this is of a very short duration compared to the period of the carrier frequency, $\omega_c$.

The special richness which may be produced by the technique of the present invention lies in the fact that there are ratios of the carrier and modulating frequencies and values of the index which will produce sideband components that fall in the negative frequency domain of the spectrum. These negative components reflect around 0 Hz and "mix" with the components in the positive domain. The variety of frequency relations which result from this mix is vast and includes both harmonic and inharmonic spectra.

A simple but very useful example of reflected side frequencies occurs if the ratio of the carrier to modulating frequencies is unity. For the values $\omega_c = 100$ Hz
$\omega_m = 100$ Hz
$I = 4$ The component at 0 Hz represents a constant in the wave. The remaining lower-side frequencies are reflected into the positive frequency domain with a change of sign (inversion of phase) and add algebraically to the components which are already there. For example the second lower-side frequency will add to the carrier with like signs, therefore increasing the energy at 100 Hz, while the third lower-side frequency will add to the first upper-side frequency with unlike signs, decreasing the energy at 200 Hz. The foregoing as well as other facets of the present invention is discussed in an article by the present inventor in the *Journal of the Audio Engineering Society*, September, 1973, entitled "The Synthesis of Complex Audio Spectra by Means of Frequency Modulation."

A formant peak may be accomplished by the FM modulation technique of the present invention in accordance with $$e = A_{sin}\,(\omega_{c1}t + \omega_{c2}t + I(t)\sin\omega_m t) \qquad (3)$$

where $\omega_{c1} + \omega_{c2}$ are two carrier frequencies having ratios with $\omega_m$. Such ratios typically being $\omega_{c2}/\omega_m = 7/1$ and $\omega_{c1}1\omega_m = 1/1$ and the 7/1 ratio placing the formant peak at the seventh harmonic.

From the foregoing it is apparent that the present invention provides a simple technique for providing for the timbral evolution for the various frequencies or partials of a complex musical sound. Moreover, the present invention realizes such timbal evolution especially in the attack portion of the sound often provides the "signature" of the sound. In other words, this is what the listener judges as the lively quality of the sound. In contrast, it is the fixed proportion spectrum of most synthesized sounds that readily imparts to the listener the electronic cue and lifeless quality. The FM synthesis technique of the present invention is far simpler than additive or subtractive synthesis techniques which can produce similar spectra. It is believed that the FM technique of the present invention duplicates natural sounds more cost effectively than if a very complex computer were utilized to control the amplitudes of individual partial frequencies in a very precise manner. In other words, although the control of the present invention is seemingly limited in that precise amplitude control of each partial frequency cannot be varied fully as desired, this proves to be no limitation as far as the subjective musical impression is concerned.

Finally, the present invention may be capable of generating "musical sounds" which have not heretofore been heard by a human being. Thus, the use of the term "musical sound" is not meant to be limited to the standard musical sounds now known.

From the foregoing, it is apparent that the frequency modulation technique of the present invention is quite different from the addition of a typical vibrato or periodic variation of a frequency around some average which is added to a musical sound. In vibrato, the modulating frequency is merely a few cycles per second and thus the ear has little difficulty tracking the instantaneous frequency of the carrier. However, where the carriers and modulating frequencies are either equal or of approximately the same order of magnitude, the ear can no longer track the instantaneous change in frequency as a sweep frequency but rather perceives a complex spectrum.

Although the MUSIC V program will produce musical sounds in accordance with the FM techniques of this invention, if real-time operation is desired, a digital FM synthesizer should be used.

Figure 5:
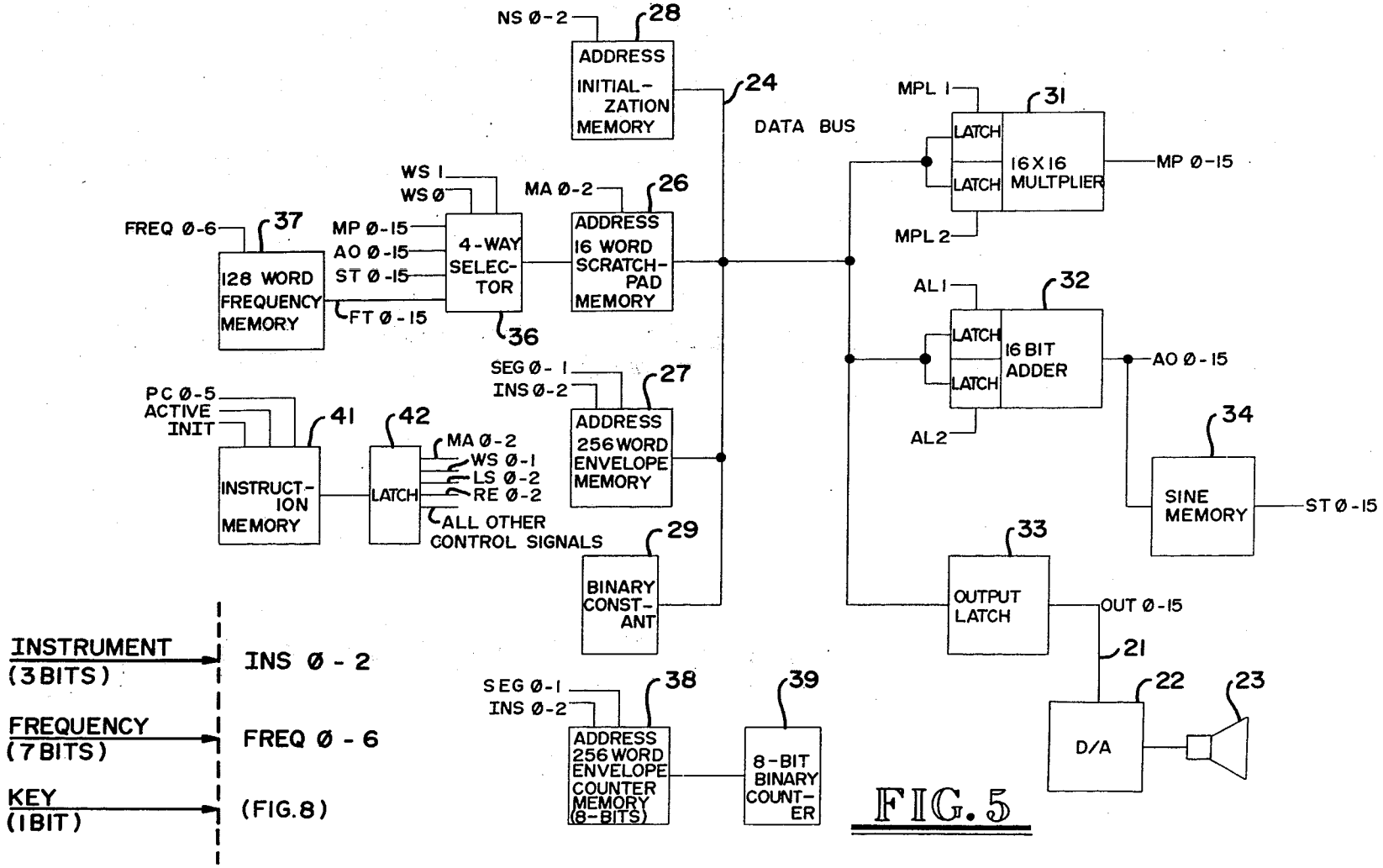
FIGS. 5 through 18 are block diagrams for a digital FM synthesizer embodied in the present invention.

FIG. 5 illustrates a micro-programmed device which has a digital output on line 21 which is converted to analog output by digital to analog converter 22 to produce the desired musical sound at loudspeaker 23. The device has as its inputs a 3 bit binary number representing the instrument or rather a selection of different timbres or tone quality, a seven bit binary number representing the desired frequency of the musical note and a key bit which initiates the generation of the musical sound. The synthesizer will then generate successive 16 bit binary numbers on its output 21 which represents the waveform at 50 microsecond intervals. If the device is to be used as the sound generating part of, for example, an organ all that is required is to feed the number of the key that is being depressed as the frequency information and, of course, the actual pressing of the key. All of the blocks of FIG. 5 are shown in detail in subsequent drawings and can be made up with standard off-the-shelf components. Each block in FIGS. 6–18 is labeled with a standard type number which may be found in the TTL Data Book, Number CC-411, Texas Instruments, Incorporated and INTEL Data Catalog, October; 1973, and ordered from Texas Instruments Components, Group, Market Communications Depart., P.O. Box 5012, M.S. 84, Dallas, Texas 75222 and Intel Corporation, 3065 Bowers Avenue, Santa Clara, California 95051.

Referring now specifically to FIG. 5, there are illustrated both sources of information and sinks. All data is communicated over the data bus 24. The sources of information are a scratch pad memory 26, envelope memory 27, initialization memory 28 and a binary constant 29. The sinks are a multiplier 31, adder 32 and the output latch for register 33. Two other sinks are not directly connected to the data bus are the sine memory 34 which is a read only memory and in addition, scratch pad memory 26 which can also accept data. Information in the search pad memory 26 is inputed by a four way selector 36 and a frequency memory 37. Envelope counter memory 38 which is driven by an eight bit binary counter 39 provides a segmented envelope as will be discussed below.

Lastly, the actual program for the digital synthesizer is provided by an instruction memory 41 and its associated latch 42. Such memory is shown in greater detail in FIG. 6 and consists of four 74186 read only memories that can hold 64 eight bit words each. Thus, a combination of two of the memories produces a standard 16 bit instruction word labeled I0 through I15. The memory pair 41*a* is for the 64 word running program and the pair 41*b* for the start up program. The start up program is initiated by a true signal on the active input. After this 64 word program is run through once, the running program then cycles. Each cycle is 50 microseconds in which time the running program cycles through all 64 words and then starts at the beginning again. This 50 microseconds is also the sample time; that is a new sample is delivered to the D/A converter 22 (FIG. 5) for every sample time. Memories 41*a*, *b* are addressed by the program counter which consists of blocks 43 and 44 which has as outputs PC0 through PC5. These signals address the instruction memories at the inputs indicated advancing the instruction and then wrapping around at 63 back to zero. The latches 42 store on each cycle the output of the read only memories 41; that is, the 16 bits of the instruction word I0–I15 are stored into the latches. The outputs of the latches perform the following functions. The MA0, 1,2,3, outputs serve as a memory address for the scratchpad memory 26 (FIG. 5). WS0, 1 controls the selector 36 which controls what is written into the scratchpad memory 26. In general the scratchpad memory 26 can be written into from four sources. Namely, the multiplier 31, adder 32, sine memory 34 and frequency memory 37. This occurs at initialize time discussed in conjunction with FIG. 11.

Referring now again to FIG. 6, the outputs LS0, 1, and 2 form a three bit binary number which decodes to one of either latch selects which are for the purpose of directing information to the system. Specifically, one of its functions is to specify which data sink will latch the data that is on the bus. RE0, 1, 2 form a three bit binary number which selects a data source to be gated onto the bus. LOB is for the purpose of gating the low order eight bits of the scratchpad memory onto the bus. The purpose of LOB is for sine wave interpolation where the 16 bit angle of which the sine is being taken is divided into a high order eight bits and low order eight bits. Since the sine memory 34 itself only accepts the high order eight bits, the interpolation is done on the low order eight bits and the LOB signal essentially turns off the high order bits and sets them to zero when it goes onto the bus. ISEL and SSEL select which envelope function is of interest. They are finally directed to the envelope memory 27 of FIG. 5. They can select either an amplitude function or a modulation index function or the second modulation index function. The WE signal in this instruction word from the latches 42 is write enable and enables writing into the scratchpad memory 26. Lastly, WS0, 1, provide the scratchpad memory write data and selects one of four inputs to the scratchpad memory which are multiplier, adder, sine table and frequency memory.

Figure 6:
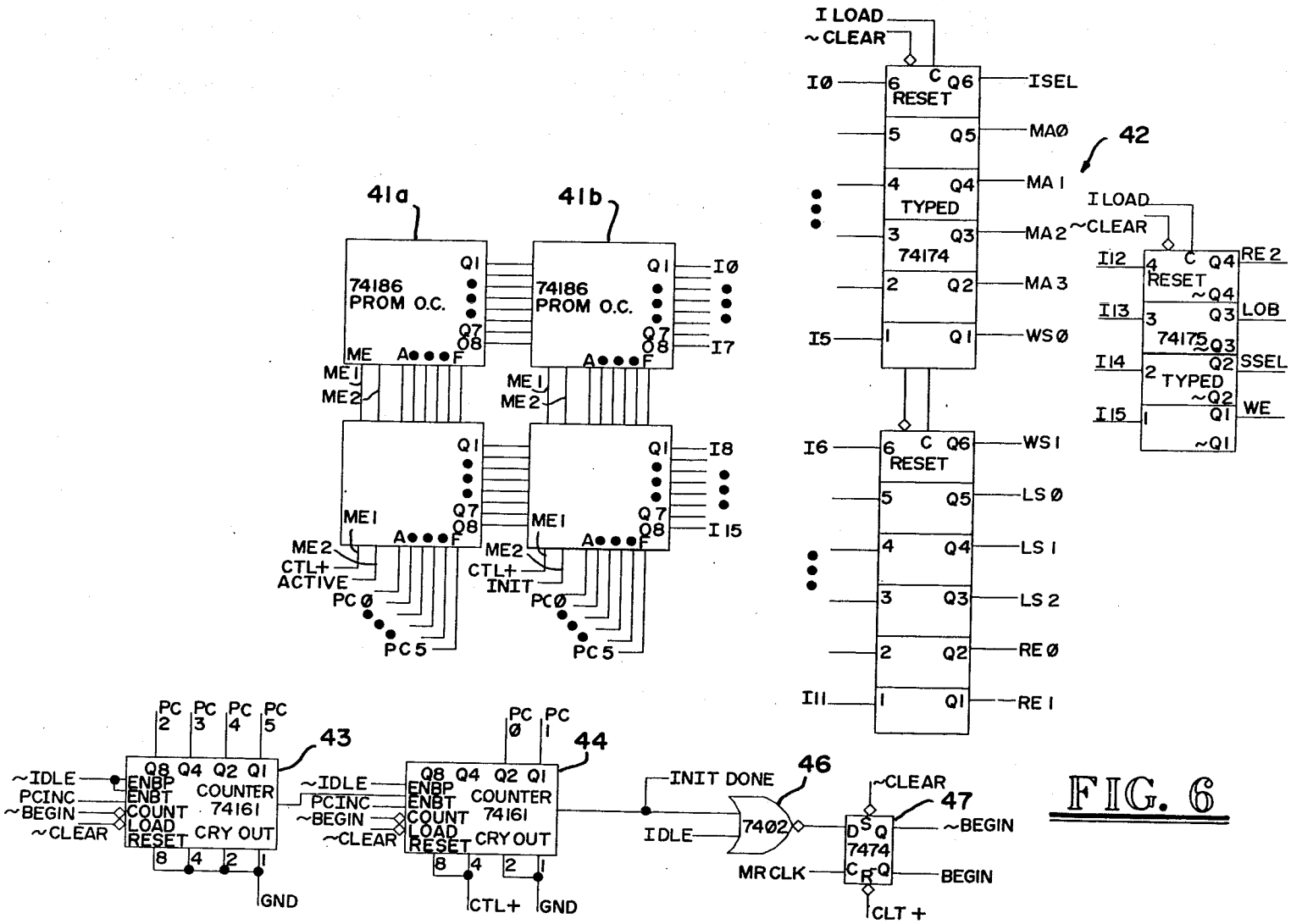

The remaining gating shown in FIG. 6 is AND gate 40, OR gating 46, and D flip-flop 47 which serve the purpose of shutting off initializing after start up. During start up the system is in INIT state. This state is completed by an Init Done signal (which is an input to OR gate 46) which means that the program counter has overflowed and the initialization program is completed. In general in operation if, for example, an update on the amplitude of the output sinusoid is desired, this is accomplished by storing the current value of the amplitude of the sinusoid and scratchpad memory 26 and then reading out of the envelope memory 27 the increment to that value. Thus, on one instruction cycle the scratchpad memory will be gated onto the data bus by the adder latches of adder 32 and the adder will latch onto the current amplitude position. On the next instruction cycle the envelope memory 27 is gated onto the data bus and the other adder latch activated. A few microseconds later, the sum appears at the adder output, AO0–15.

Figure 7:
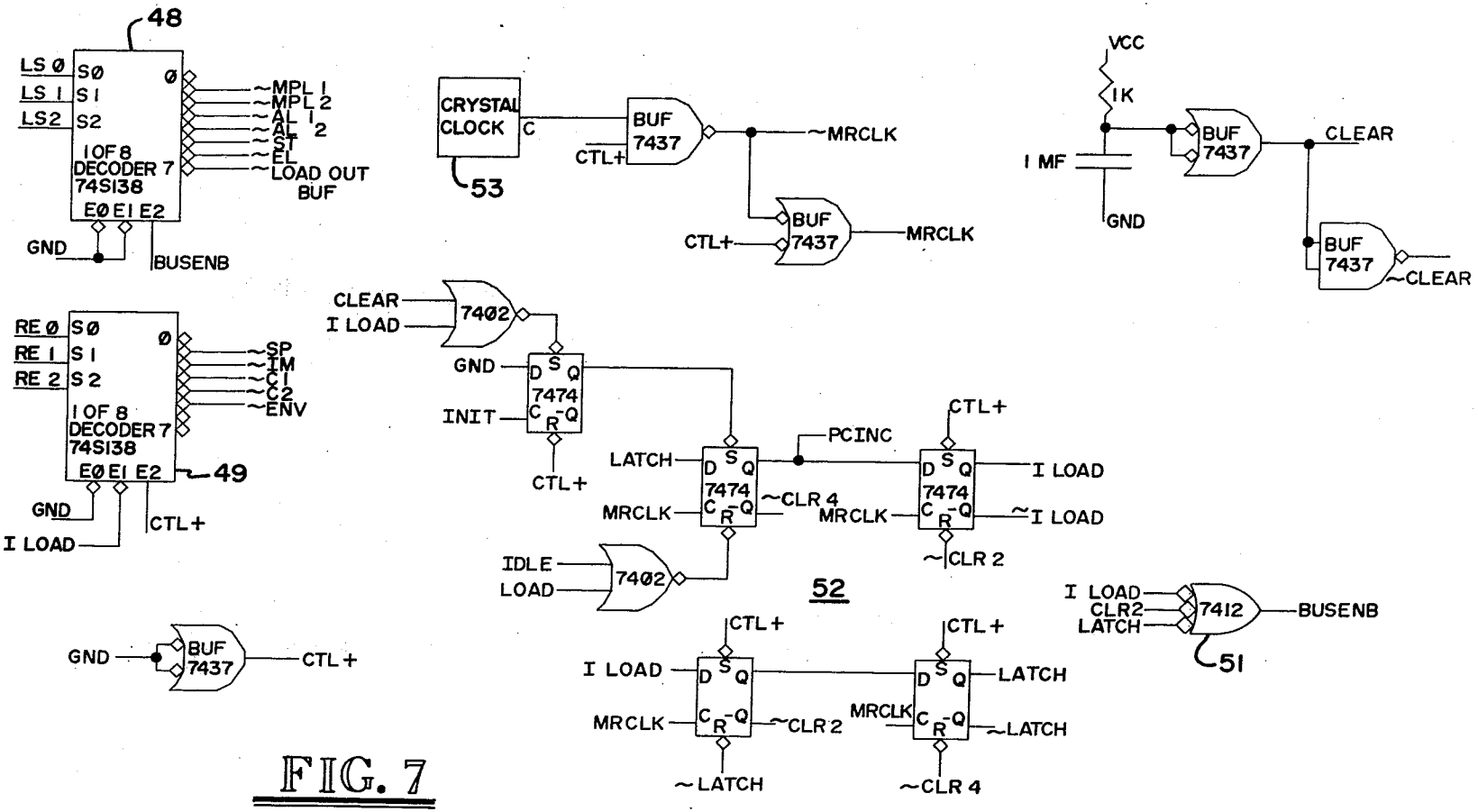

FIG. 7 provides control logic for the latch instruction outputs of FIG. 6. Specifically the latch select bits LS0, 1, 2 are coupled to a decoder 48 which produces when enabled a signal on one of eight different lines. These include the multiplier latch signals MPL1, 2 and adder latch signals AL1, 2. Also, sine table latch, ST and a signal EL which is used as a control signal to cycle the envelope memory onto the next segment; this occurs once every 63 instructions. This is done because of a lack of sufficient bits in the instruction word. The last output "load output buffer" causes the output latch 33 (FIG. 1) to store words from the data bus.

Control bits RE0, 1, 2 to decoder 49 determine which of four data sources are gated onto the data bus. Output SP gates the scratchpad memory onto the bus; IM gates the initialization memory 28 onto the bus. Such memory contains data as for example, the factor by which the fundamental frequency is multiplied to produce either the modulating frequency or carrier frequency. As is apparent from the foregoing examples, this is generally an small integer factor of 1, 2, 3. This is, of course, done at the initialization time. The constant C1 is ¾ which is the difference between a sine and cosine angle so that a cosine angle may be processed as a sine angle during sine table table interpolation. C2 is unused. ENV gates the envelope memory 27 onto the bus which, of course, contains the increment that is to be added to the current value of either the modulation index or amplitude envelope for the next step.

Memory 48 is enabled by a bus enable input which is produced by the gate 51 having as inputs I load, CLR 2 and latch. Decoder 49 is enabled by single I Load. Both I load and latch are generated by the four coupled flip-flops 52 which are fired in order; that is, only one of them is true at any one time. Flip-flops 52 count the master clock (MRCLK) and each time the master clock goes true the stored bit advances to the next flip-flop. The first flip-flop increments the program counter with the output PCINC and in turn the program counter causes data to be produced from the read only instruction memories 41. At the next clock pulse I Load will be produced which latches the instruction word and gates the data source onto the data. The next clock cycle is wait and on the last clock cycle LATCH will come true and will cause whatever data is present on the data but to be latched into one of the data sinks. This completes an instruction cycle at which time the initial flip-flop causes the program counter to increment another step. Thus, in operation in general at I load the instruction word is produced and control signals propagate around the system, the data getting gated onto the bus and then latched off the bus to perform whatever function is desired as, for example, adding or multiplying.

The last two functions illustrated in FIG. 7 include the production of the master clock which is produced by the crystal clock 53. The clock runs at a rate such that an instruction word is executed in about 800 nanoseconds which thus allows 64 instruction words in 50 microseconds. Finally, OR and AND gates provide a clear pulse so that when power is supplied to the device all registers are reset.

The major states of the device from a system standpoint are Idle, Init, Run, and Decay. In the Idle state there is no note playing and no key is depressed. When a key is depressed the device goes into Inite state and it runs the 64 word initialize program in the instruction memory. When that program is finished, it automatically goes into Run state and it stays in Run state until the key is lifted. When the key is lifted it goes into Decay state. How long it stays in Decay state is determined by the Decay envelope in the envelope memory. When it completes the Decay envelope, then the device goes back into the Idle state. There are also some substates associated with envelope control. For instance, the Run state is divided into two sub-states called Attack and Steady State and Decay major state is called a run-down state in the envelope control. This renaming is to prevent a timing problem. The timing problem is if the key stroke is very very short such that the device is still in the Attack sub-state but the key is lifted the envelope control keeps it in Attack state until the attack is finished and then goes into Decay state; so it will never abort the attack because of a very short key stroke.

Figure 8:
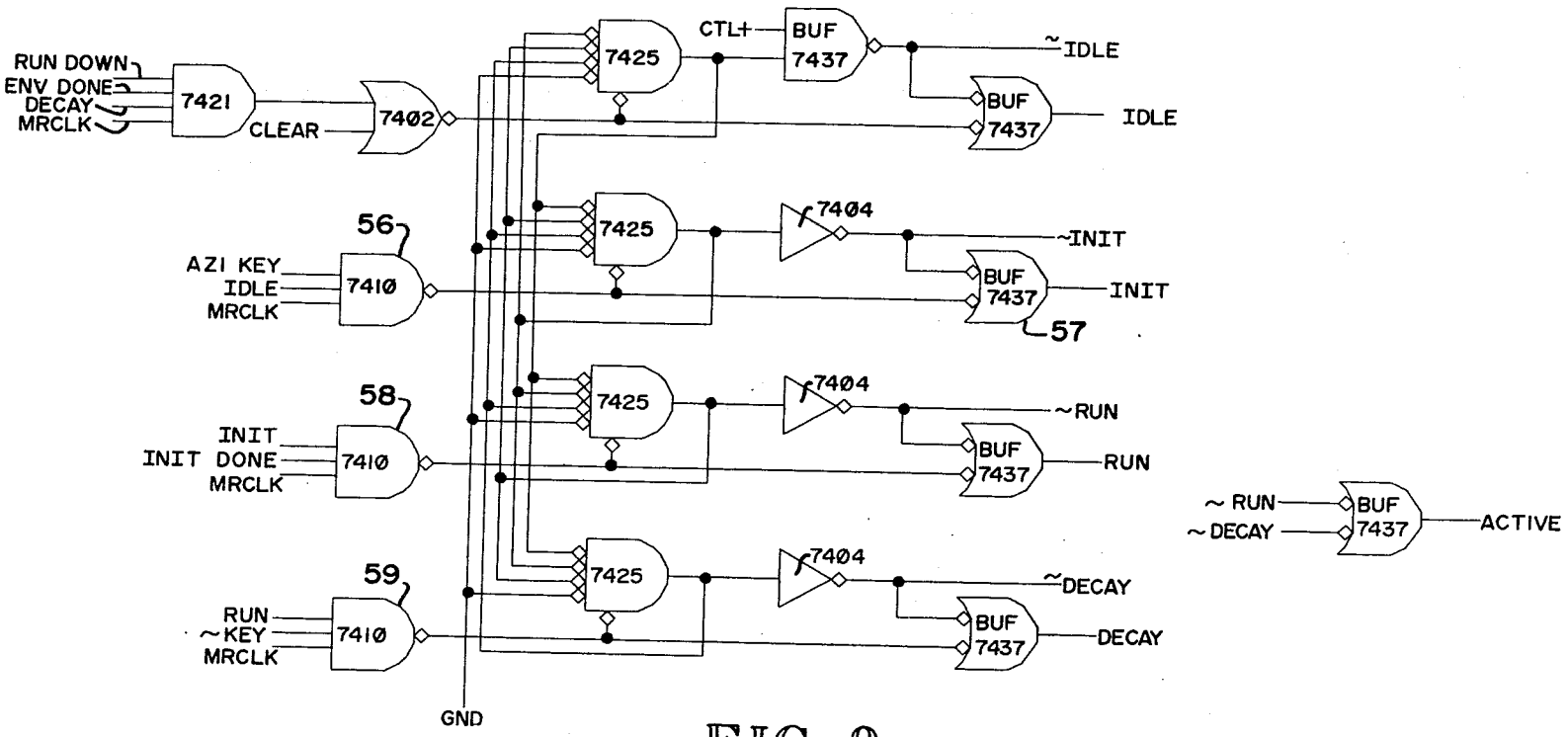

The foregoing is illustrated in the state diagram of FIG. 8. Changing states is done on the AND of the previous state and the state changing condition and the clock. For instance, to get out of Idle state, there must be present the AND (gate 56) of Idle, the key has become depressed, and master clock (MRCLK); gate 57 goes into the Init state. To get out of Init state, Init Done must come up to activate gate 58. Init Done (FIG. 6) comes true when the program counter 44 reaches 63; that is, the initialize program is finished. Run state is gotten out of by being in Run state and the key being raised; that is, "Not" Key comes true and the master clock closes gate 59 to go into Decay. Finally Idle state is returned to by being in a Run Down substate as Envelope Done comes up, Decay is true and master clock. Thus, if the device is in Decay mode and the envelope has cycled all the way through into Run Down mode and is done, signified by Envelope Done, the Idle is returned to.

Figure 9:
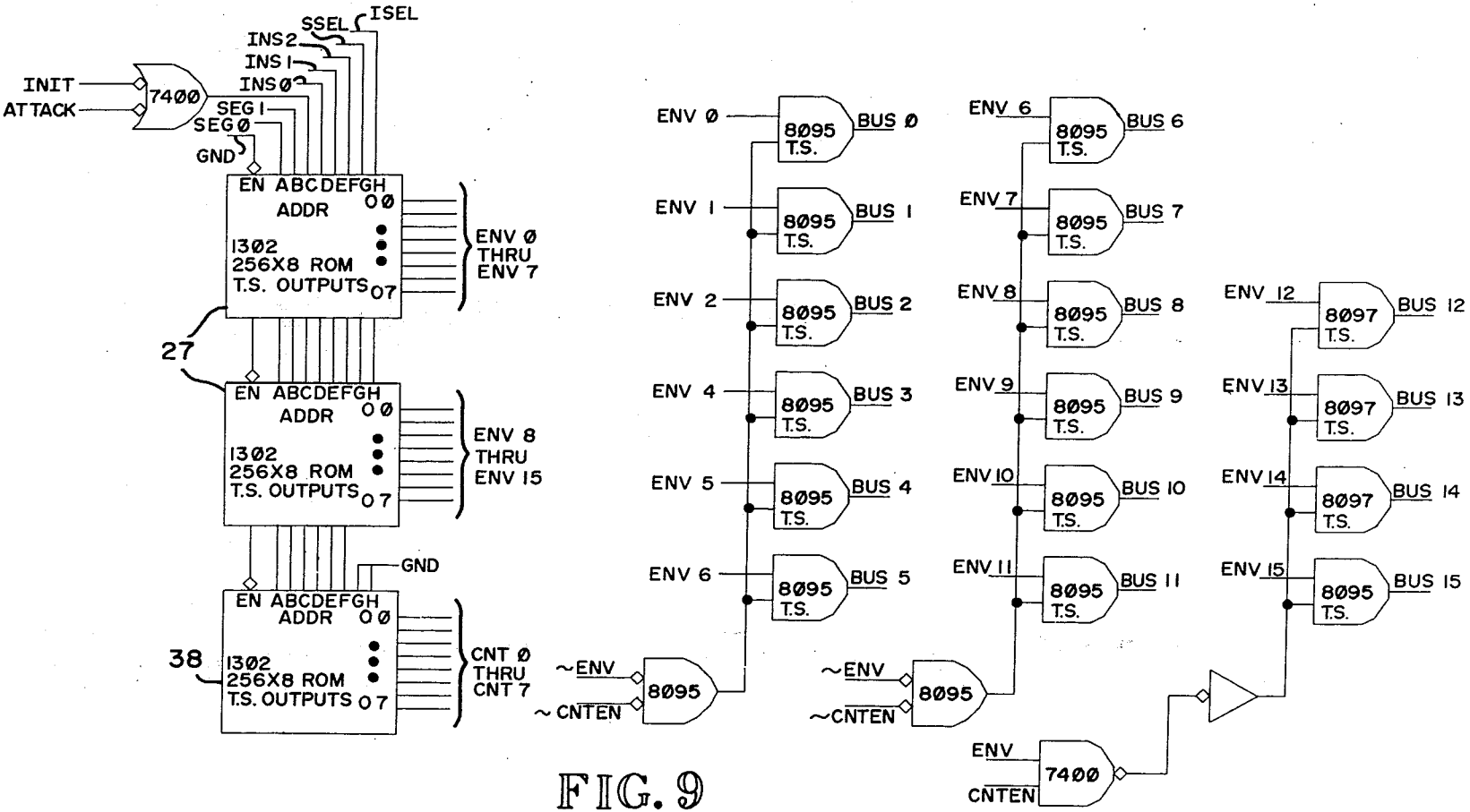

FIG. 9 contains the blocks envelope memory 27 and envelope counter memory 38 of FIG. 5. These are all INTEL (trademark) model 1302 (see INTEL Data Catalog) read only memories. The envelope memory consists of two 1302s which provide 256 different 16 bit words. These 16 bit words as they come out of the memory are labeled Env 0, 1, through 15. They are the increments to the current position, e.g., the attach amplitude or the modulation index or the second modulation index. The envelope words are the amount that is added to those amplitudes at each sample cycle; that is, at one loop of the instruction memory; (50 microseconds). The envelope counter memory 38 specifies the number of sample cycles where the above increment is true; the process is a piece wise linear approximation and the counter memory specifies the number of samples for each piece of the piece wise linear segment. The number ENV 0 through ENV 15 is actually related to the slope of that piece wise linear segment. The counter memory generates an eight bit count CNT 0 through 7.

All of the above is addressed by various inputs. There is instrument number which is a three bit number INS 0, 1 and 2 where different Attack and Decay envelopes are selected for different instruments. With the segment number SEG 0, 1, an Attack can be synthesized on any instrument with up to four segments and the Decay with up to four segments. Also gated is the signal "attack" which selects a different set of piece-wise linear segments for the attack compared to the decay. The signal Init is ORed with Attack to ensure that the data will be ready as soon as the Init state is completed and Attack is begun. The other two bits in the eight bit address are SSEL and ISEL from the instruction word; they select the desired envelope which may be the Attack envelope, the first modulation index envelope or the second modulation index envelope.

All the other gates on FIG. 9 gate the envelopes onto the bus. They are tristate buffers which have three states; true, false and not enabled. Data is gated onto the bus with the OR of two signals; ENV which is from the read enable bits of the instruction word, that is decoder 49 (FIG. 7) and CNTEN or count enable. Count enable is true if the device is in Attack and not in Decay; that is, count enable specifies that the amplitudes are changing. Otherwise the device is in steady state and the amplitudes are not changing and therefore zeros are gated onto the bus. Gating zeros onto the bus is illustrated in FIG. 7; gating the envelope increment itself onto the bus as shown in FIG. 9.

Figure 10:
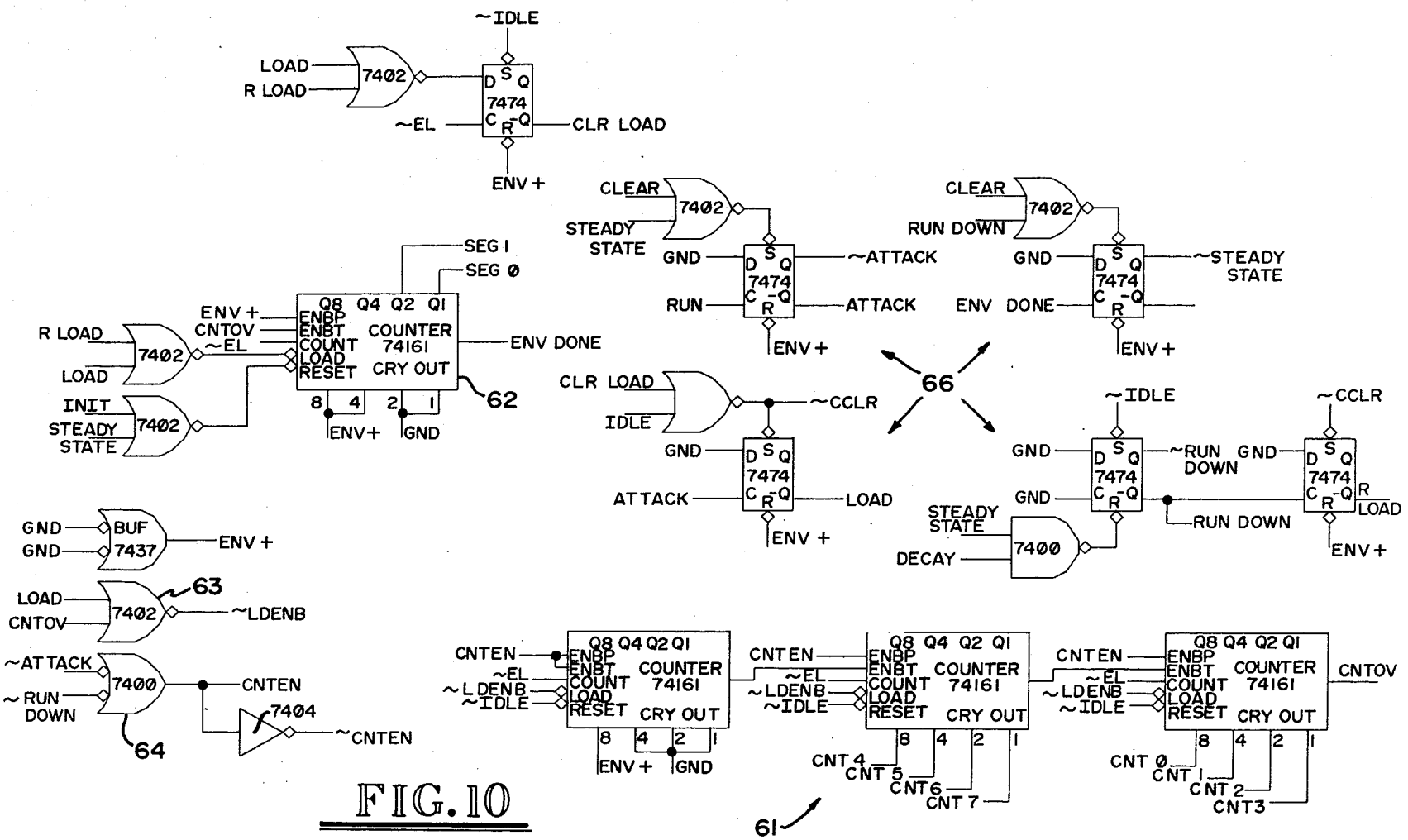

FIG. 10 illustrates envelope control and contains two sets of counters. The first set of counters 61 consists of three counters which take in the count from the envelope counter memory which is an eight bit count 0–7 and counts the number of EL signals. The EL signal is a decoded latch select and there is one in every sample cycle; that is, one instruction of the 63 instructions turns the EL bit on. Thus, counters 61 essentially count samples. The number that comes out of the envelope counter memory is the negative or the two's complement of the number of samples to count until the segment is completed. Counters 61 are enabled by CNTEN, count enable, and they only count if in an attack mode or run-down mode which is physically the Attack or the Decay of the signal. When counters 61 overflow, CNTOV goes true, counter overflow, and allows the other counter 62 in FIG. 10 to count. Counter 62 counts which of the four segments of the piece-wise linear approximation is being processed. That is, at initialize time counter 62 is cleared and its output is Seg 0 and Seg 1 and this goes directly into the address of the envelope memory and the envelope counter memory. In operation, some number of samples is counted and then CNTOV goes true and counts to the next segment. A new count is reloaded and the number of samples in that segment is counted. When four segments have been counted through, envelope done comes true. That will cause, if in an Attack mode, a move to Steady State; in Run Down it will cause a return to Idle.

There are a few other input signals. For instance, load enable, LDENB, enables the loading of the sample counter 61 by the envelope counter memory 27 and is generated by the OR (gate 63) of load and CNTOV when the counter overflows; CNTOV has gone true and a new count is ready to be accepted. However, upon going into Attack mode the count has not overflowed and some way of getting it started is needed. Thus, when attack first goes true, Load is set.

Count enable, CNTEN is generated by the OR of Attack and RUN Down (gate 64). This is essentially true during the Attack Decay portions of the waveform but it is not identical to the Decay major state. Specifically, four flip-flop 66 form a four-flop. Attack is generated by going into the Run major state, then Attack goes true and it also brings Load true. But Load only stays true for one sample cycle whereas, Attack will stay true until Envelope Done comes up; that is, until all four segments have been counted through. Thereafter, Steady State mode will be stayed in until essentially going into Decay major state; that is until the key is lifted; then the device goes into Run Down mode. R load is generated like Load; that is, it stays on momentarily whereas Run Down stays on until Envelope Done comes true. If the key is tapped very very shortly, the major state will change to Decay but the device will stay in Attack mode until Envelope Done comes true; then it will go into Steady State for just an instant and then flip into Run Down mode.

Figure 11:
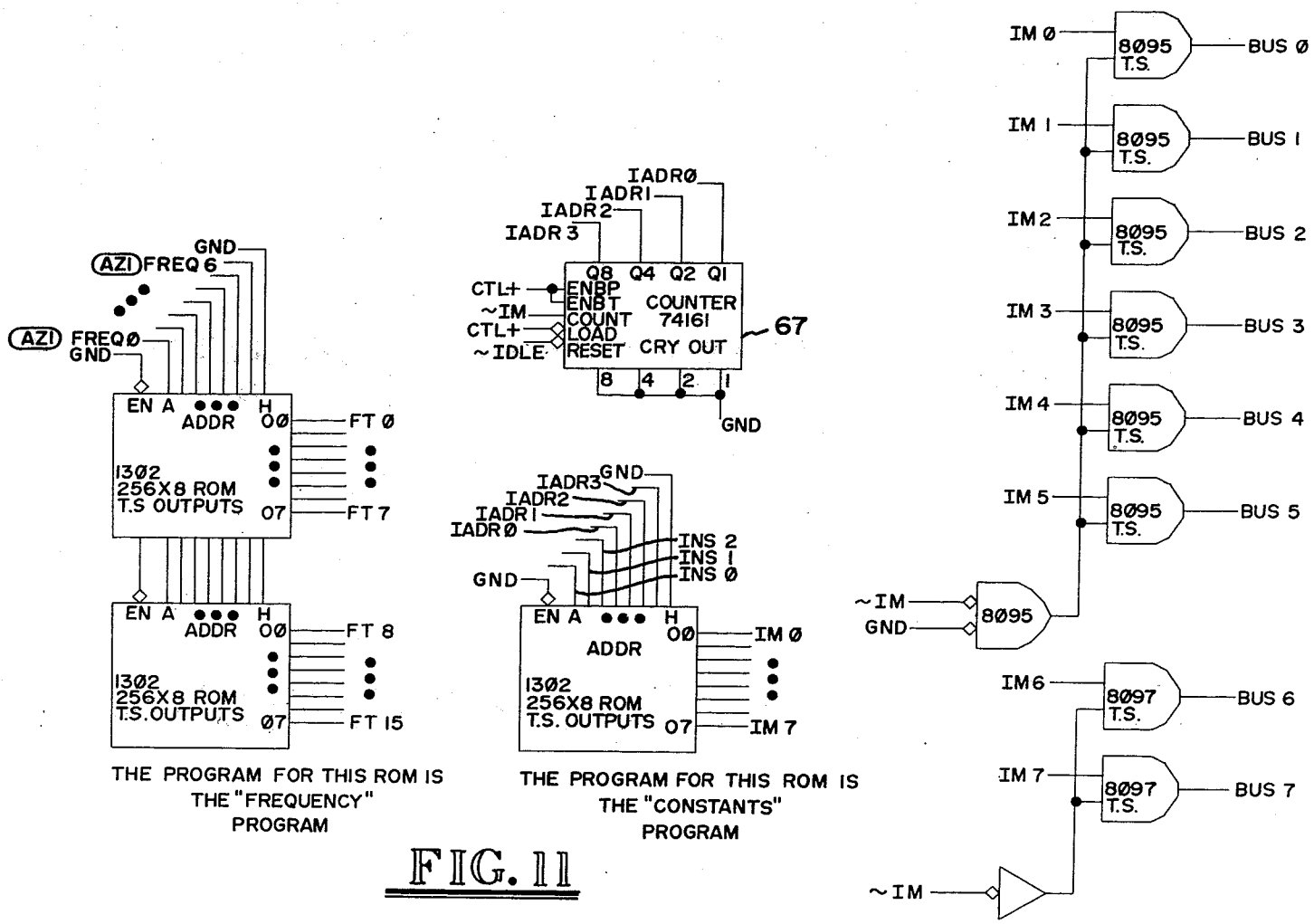
Figure 12:
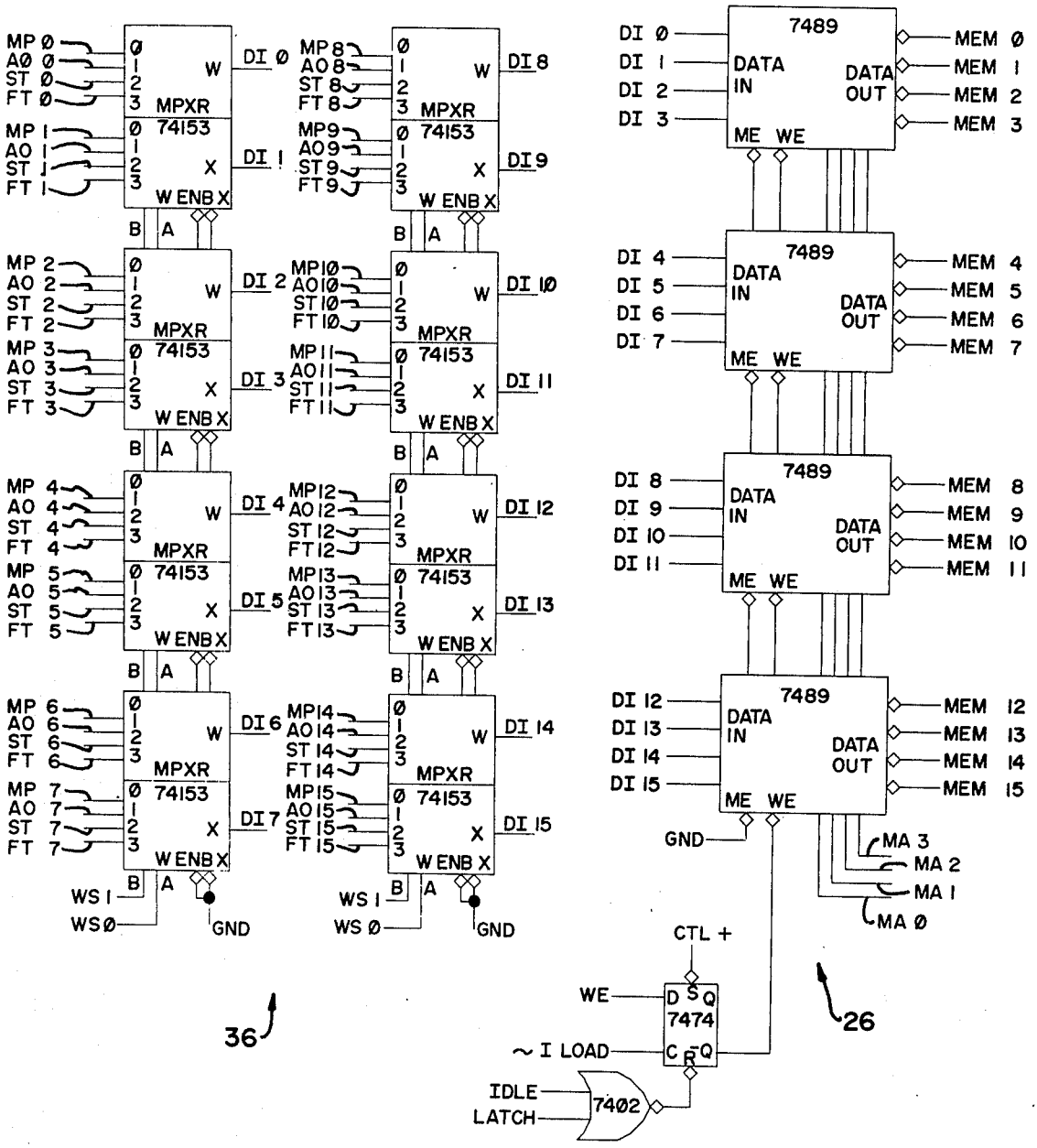

FIG. 11 is a more detailed diagram of blocks frequency memory 37 and initialization memory 28 of FIG. 5. The frequency memory is coupled directly to the selector 36 for the scratchpad memory 26 and the initialization memory 28 can be gated onto the bus. Since the initialization memory is only 8 eights, only the higher order 8 bits is gated onto the bus and the low order 8 bits are gated as zeros as illustrated in FIG. 12.

Referring in detail to FIG. 11, inputed to the frequency memory is a 7 bit number, FREQ 0 through 6. In actuality, this is the number of a key starting at A natural 27.5 Hertz and every number specifies a half step from that low A; that is, 128 frequency numbers can specify a seven octave range above low low A. This is transformed via the frequency memory into an actual frequency number. Thus the frequency number is the amount that is added to the current position of the sine table to get the next position in the sine table. That is, this is the incremental angle of which the sine is taken. Memory outputs FT0 through FT15 are coupled into the selector 36 (FIG. 5) which can be selected by WS0 and 1 in the instruction word which is the write select into the scratchpad memory.

The initialization memory is addressed by the three bits of the instruction and also by a four bit counter; that is, up to 16 initialization constants can be supplied and every time the program asks for a new initialization constant with the IM signals (decoded from RE0 through 2) the read enable, which gates data onto the bus, will count counter 67 and thus go to a new initialization constant. The program essentially has to know what these constants are and what order they are stored in.

The kind of constants that are stored in the initialization memory are the following: for most versatility, the frequency of the carrier sinusoid and the modulating sinusoid are not necessarily the same frequency as the fundamental frequency. The difference is that they will in general be small integral multiples of the fundamental frequency. Those integral multiples 0, 1, 2 or 3 or so are stored in the initialized memory to be later read out. The other information that is stored in the initialized memory are the beginning amplitudes. For example, some amplitude envelopes start at a non-zero number like the bell which starts at a loud point and decay down. However, for most instruments, those numbers are 0. These are stored in a specific order; i.e., the multiplier for the second modulating frequency, the multiplier for the first modulating frequency, and the multiplier for the carrier frequency. Gated out of the initialization memory onto the data bus (IM0–7) are the beginning positions for the angle of which the sine is taken, which in most cases is 0. The next three numbers gated out of the initialization memory are the first modulating index, $I_1$, the second modulating index, $I_2$, and the signal amplitude A. $I_1$, $I_2$ and A are actually locations in the scratchpad memory. The following is a list of the scratchpad memory locations and then the symbolic names.

| SP locations: | | |
|---|---|---|
| 0 | pos1 | |
| 1 | fr1 | ; Fm2 |
| 2 | fr108 | ; Fm2*8 |
| 3 | pos2 | |
| 4 | fr2 | ; Fm1 |
| 5 | fr208 | ; Fm1*8 |
| 6 | pos3 | |
| 7 | fr3 | ; Fc |

-continued

| | | |
|---|---|---|
| 10 | $I_2$ | ; Index 2 / 8 |
| 11 | $I_1$ | ; Index 1 / 8 |
| 12 | A | ; Amplitude envelope |
| 13 | ti2 | ; Temps |
| 14 | t1 | |
| 15 | t2 | |

Specifically, *fr*1 specifies the frequency of the second modulating index, *pos*1 is the angle of the second modulating sinusoid; *fr*2 and *pos*2 are the frequency of the first modulating waveform and the current angle of the first modulating waveform and *fr*3 and *pos*3 are the carrier frequency and its position; A, $I_1$ and $I_2$ are the amplitude envelope, index 1 and index 2, respectively. There are three temporary registers in the scratchpad memory designated *t*1, *t*2 and *ti*2. Two other numbers *fr*108, *fr*208 are the modulating frequencies times 8. This is a constant offset and is used because in actuality and indexes are divided by 8 to provide scaling because of a fixed point system.

Lastly, FIG. 11 shows the tristate buffers that gate the initialization memory onto the data bus.

FIG. 12 illustrates the scratchpad memory 26 (FIG. 5). This contains the scratchpad memory itself which are four read/write memories. These are four sixteen bit memories. Data into the scratchpad memory comes out of selector 36. The selector is selected by WS0 and 1 which comes out of the instruction word as shown in FIG. 6. This can gate in either the output of the multiplier which is MP0 through 15, the adder AO0 through 15, the sine table STO through 15 and the frequency memory FTO through 15 and the selector produces an intermediate signal OI0 through 15 which goes directly into the scratchpad memory data inputs. The scratchpad memory is always reading but it is also write enabled by WE which is a bit in the instruction word; that is, write enable, WE, and its clock ILOAD.

The write enable on the scratchpad memory is true if WE, the write enable bit of the instruction word is true. It is clocked on not I load, that is, the falling edge of the instruction load. This will set the write enable true and as soon as the latch timing signal comes up, the write enable will be turned off; that is, presumably the data will have been written by then.

Figure 13:
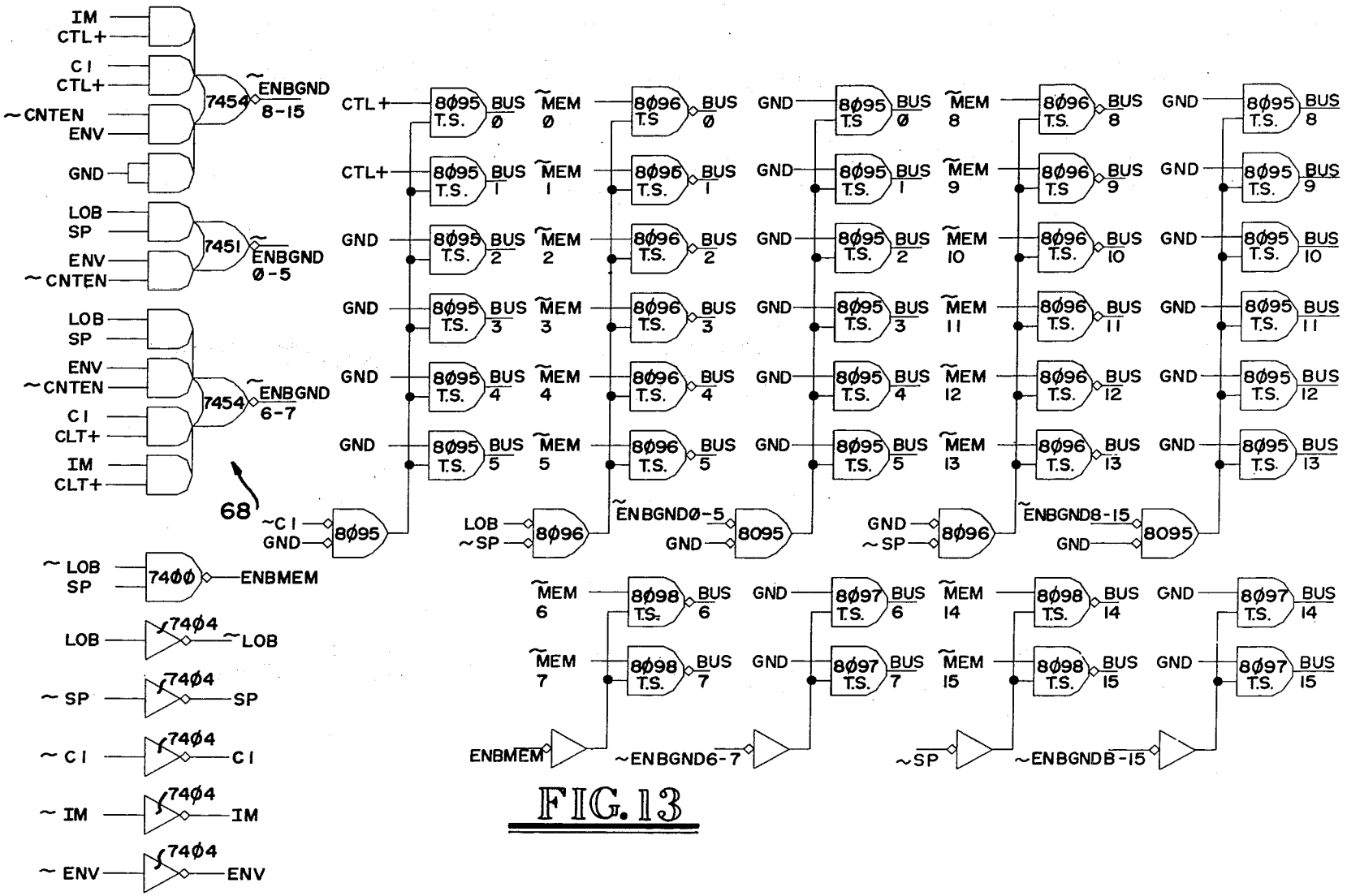

The circuit of FIG. 13 accomplishes three different things related to the data bus. It can gate scratchpad memory output which is Mem 0 through 15 onto the data bus and it can gate zeros onto the data bus. This is, of course, important for the envelope control during steady state where the amplitudes and modulation indices are not changing. Also zeros can be gated onto the high order bits of the bus if the LOB, low order bit signal is true in the instruction word. This is for doing sine table interpolation. Finally, the third thing which is gated is a constant of ¾; that is, the higher bits on ¾ of a rotation onto the bus. This is controlled by signal C1 which is one of the read enables; that is, REO through 2 go into a demultiplexer which will produce one of the signals C1. This is a constant which is added to the angle of the sine to get a cosine. It is essentially 3/2 pi.

On the left hand side of the bus are gates 68 that control operations. For instance, it is desired in a steady state condition to gate 0 on the low order bits 8–15 of the bus on the condition that the initialization memory, the IM signal, is being read from and the constant C1 from the envelope is present. It is the OR of those conditions which produces a signal ENBGND 8–15, enabled ground, on 8 through 15 and this in turn controls the tristate latches which will gate ground on the low order bits of the bus. The high order bits will gate bits 0 through 5 and bits 6 through 7 slightly differently. That is, all the bits are ground on the condition for that of steady state for the envelope. The only reason bits 0 through 5 are gated differently from bits 6 through 7 is that the constant C1 only occupies the first 6 bits and the rest of them of zeros. If C1 is true, then zeros are gated onto bits 6 through 15 of the bus and ground is enabled; that is, zeros are enabled on 6 through 7 separately; and the condition under which zeros are gated on 6 through 7 are if LOB is true; that is, low order bits are being gated. Zeros are gated onto the high order bits of the data bus from the instruction word if ENV and not count enable, CNTEN, are true; that is, if there is an envelope request and are in steady state or there is an instruction memory or an initialization memory request, or if the constant is being gated onto the bus. Zeros will also be gated onto the bus bits 0 through 5 if LOB is true; that is, low order bits only and if envelope control and steady state are true.

Figure 14:
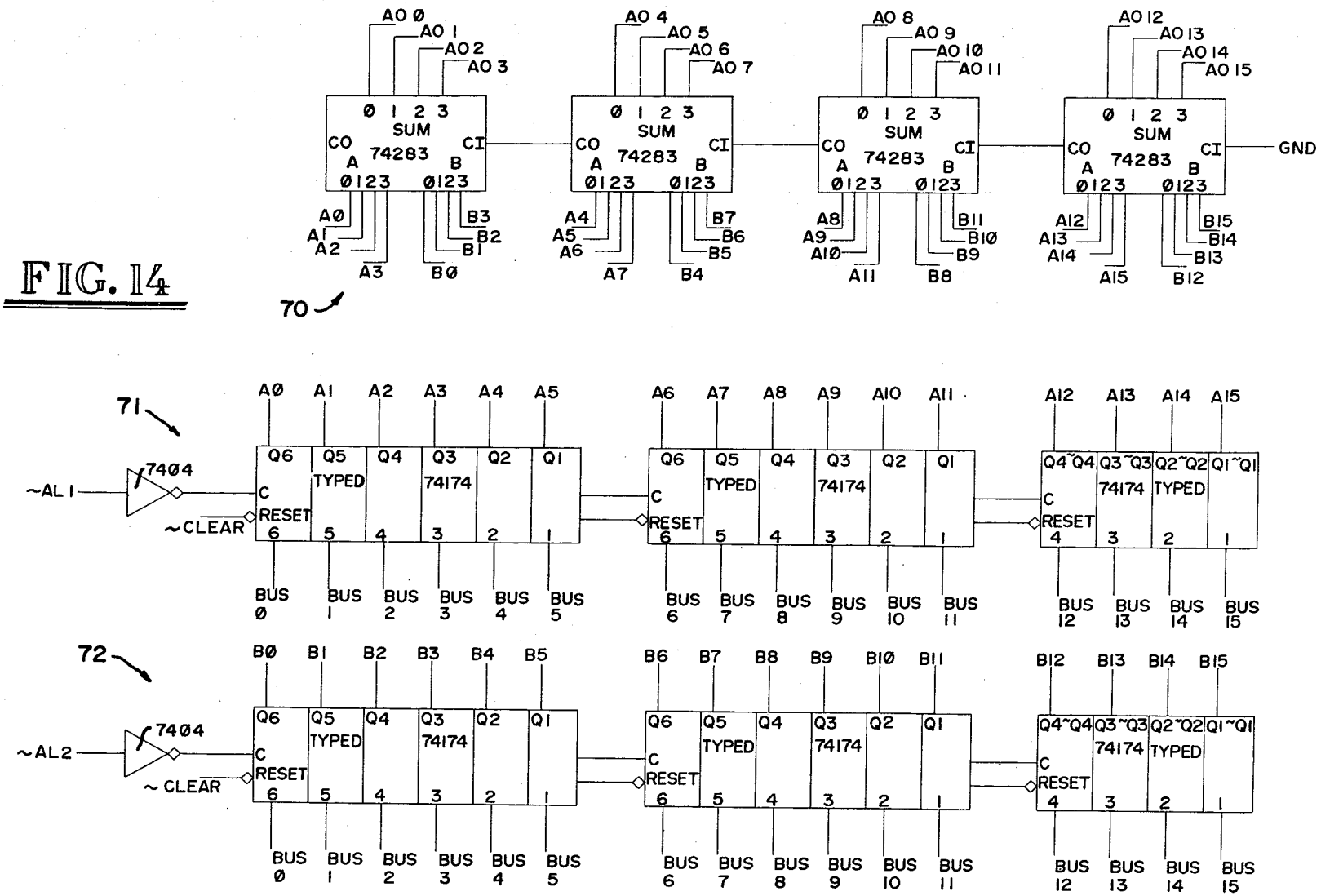

FIG. 14 illustrates the adder 32. It has three parts; a 16 bit adder 70 and two input latches 71, 72. The input latches are strobed or made to latch data from the bus, 16 bits, on the AL1 and AL2 signals; AL1 latches 71 and AL2 latches 72. The output of these latches goes directly into the 16 bit adder 70. The output of the adder is called AO 0 through 15. It is a 16 bit number. The output of the adder goes to two different places; sine table input latch and the scratchpad memory write select. When the angle of a sinusoid is being updated the angular increment is added to it and at the same time this data can go to the sine table. Thus, not only can the updated angle be stored back in the scratchpad memory but the sine table loop up can be started at the same time.

Figure 15:
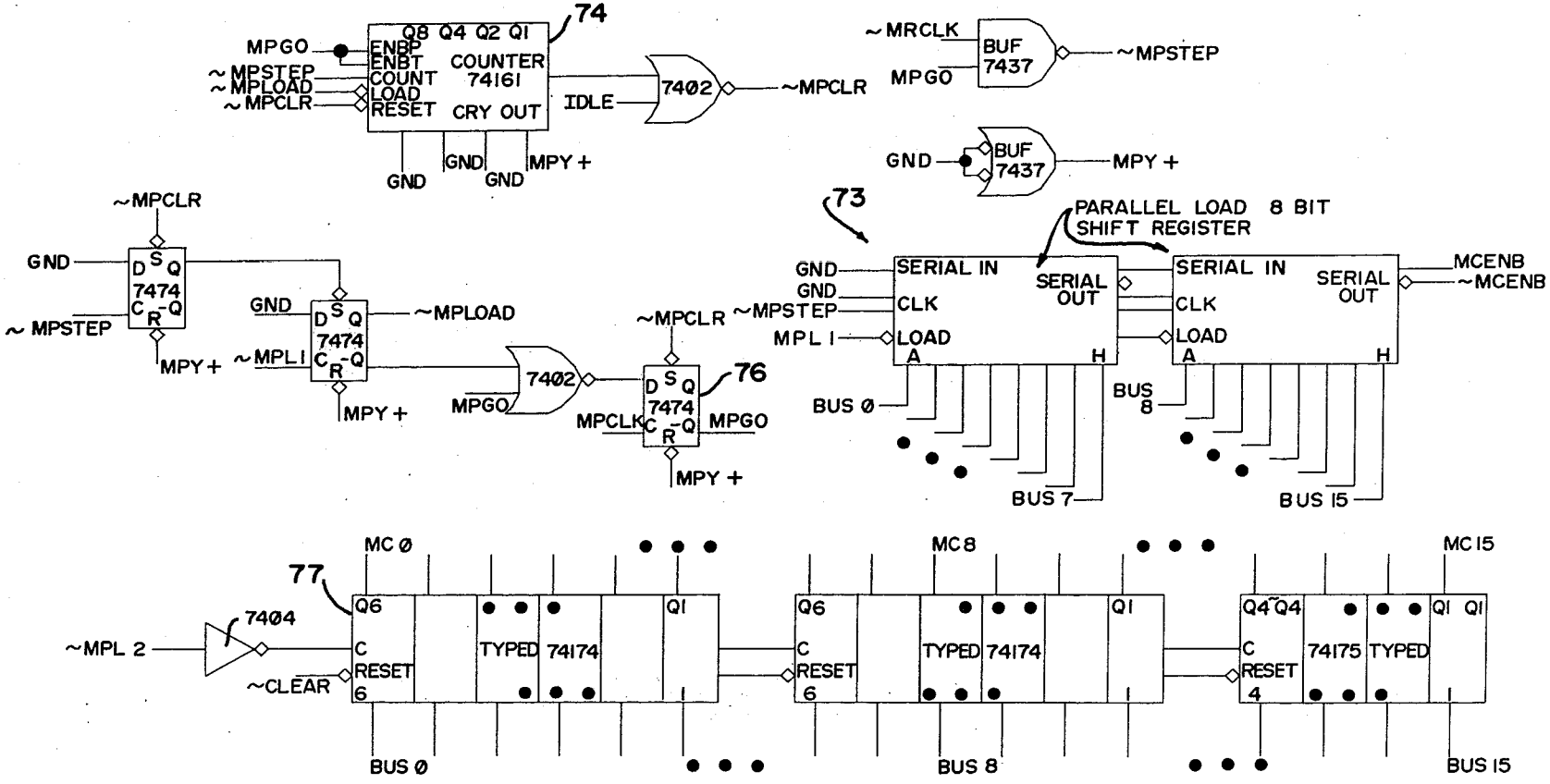
Figure 16:
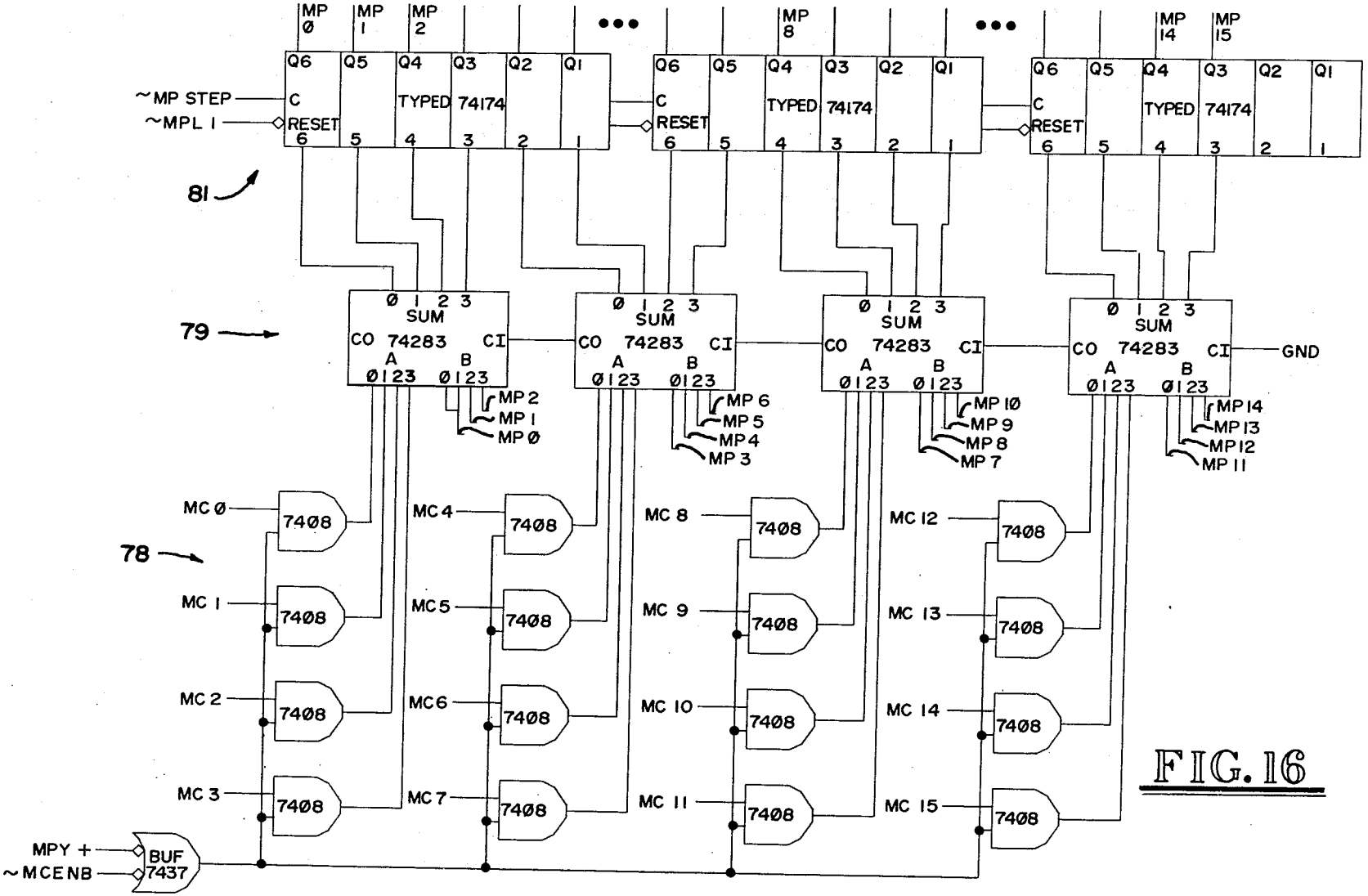

FIGS. 15 and 16 control the 16 bit multiplier 31 (FIG. 5). The 16 bit multiplier has two latches, a third latch for the partial product, a 16 bit adder, a 16 bit gate which gates the multiplicand into the 16 bit adder to add it to the partial product when shifted and it has some control logic. The control logic is essentially the multiplier latch which is actually a shift register 73 and a counter 74 that will count 15 times and then stop. It operates as follows: on signal MPL2 the multiplicand is latched into one of the multiplier latches. On signal MPL1 the multiplier is latched into a 16 bit shift register, and MPL1 also resets the multiplier control circuit. That is, the fall of MPL1 will gate MP load true which causes on the next fall of MP step, the counter to load. The counter is loaded with +1 to take 15 steps not 16. MP step is produced by MP GO and master clock flip-flop 76. However, for synchronizing purposes the output is gated round into the input. The sequence of operation is as follows: MPL1 (the signal which controls the gating of the multiplier input latch) and that gates MP load true which causes the load enable of the counter to go true and then on the next master clock, the counter will get loaded with a +1 and MPGO will be brought ture which will cause MP load to become false; then once MP GO is true, then each MP step is cycling the multiplier. With the multiplier itself the serial output of the 16 bit input latch 77 and shift register 73 is called MC enable (multiplicand enable) and is coupled into a set of gates 78 (FIG. 16) which will gate the multiplier into the adders 79 and which adds the partial product to the multiplier. At each step the MC enable or multiplicand enable will either gate the multiplicand into the adders or not. So all 15 bits of the multiplier are stepped through. The partial product is latched by latch 81 into a 16 bit register on the output. This is not shown on the block diagram but is internal to the 16 bit multiplier block. An output controlled by MP step. The output of latch 84, the signals MP 0 through MP 15, is the partial product which becomes the product after the last multiplier step. The shifting right of the partial product is accomplished in FIG. 16 simply by the ordering of the bits as they go back into the adder; that is, the bits are shifted right by one. In the first adder 79 there is the sign bit twice MP0 as the first two bits. That is, an arithmetic two complement shift right where copy the sign bit is copied into the vacated places; that is, the low order bit is discarded on every cycle because a multiply will eventually end up with a 31 bit resultant and all that is necessary is 16 bits. The multiplier is stopped by the counter 74 overflowing and this produces MP clear which turns off MP 60 and the multiplier halts. The product is available at the multiplier output (latch 81) as signals MP0 through 15. These multiplier output signals will remain true, of course, until the next time multiplication is begun. The total multiplication takes 15 clock steps. A clock step is about 200 nanoseconds so the whole multiply takes 3 microseconds or roughly five instruction cycles. Thus on the fifth instruction cycle after the multiplication is initialized, the output can be used.

The device is also busy doing other things during that time. It is slightly pipelined; that is, the multiplier may be loaded up and while computing other things like update amplitude or modulating index may be accomplished.

Figure 17:
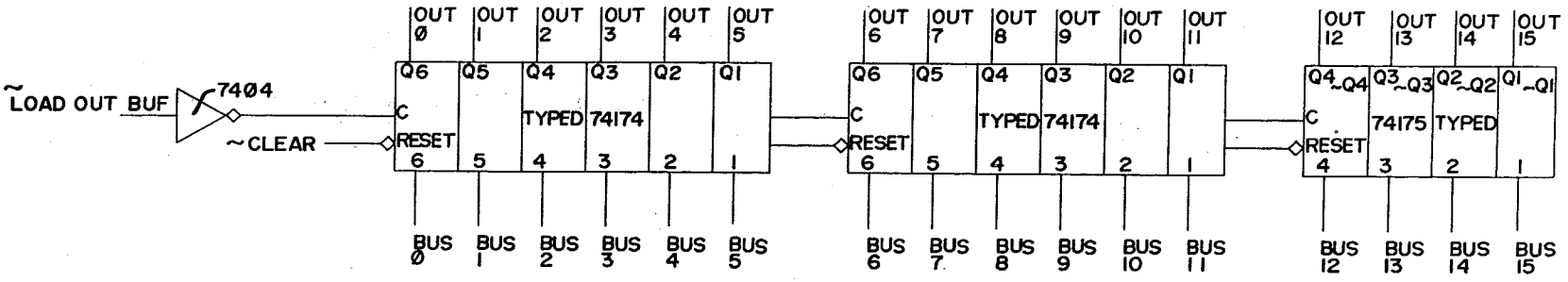

FIG. 17 is the output register and it is gated on the signal "load out buf" which is produced by the latch select bits LS0 through 1 from the instruction word; this grabs 16 bits off of the bus and latches them. The program goes through computing what the output waveform should be and then at the very last step it gates the waveform onto the data bus and strobes "load out buf" which causes the output word to be sent to the D to A converter 22 (FIG. 5).

Figure 18:
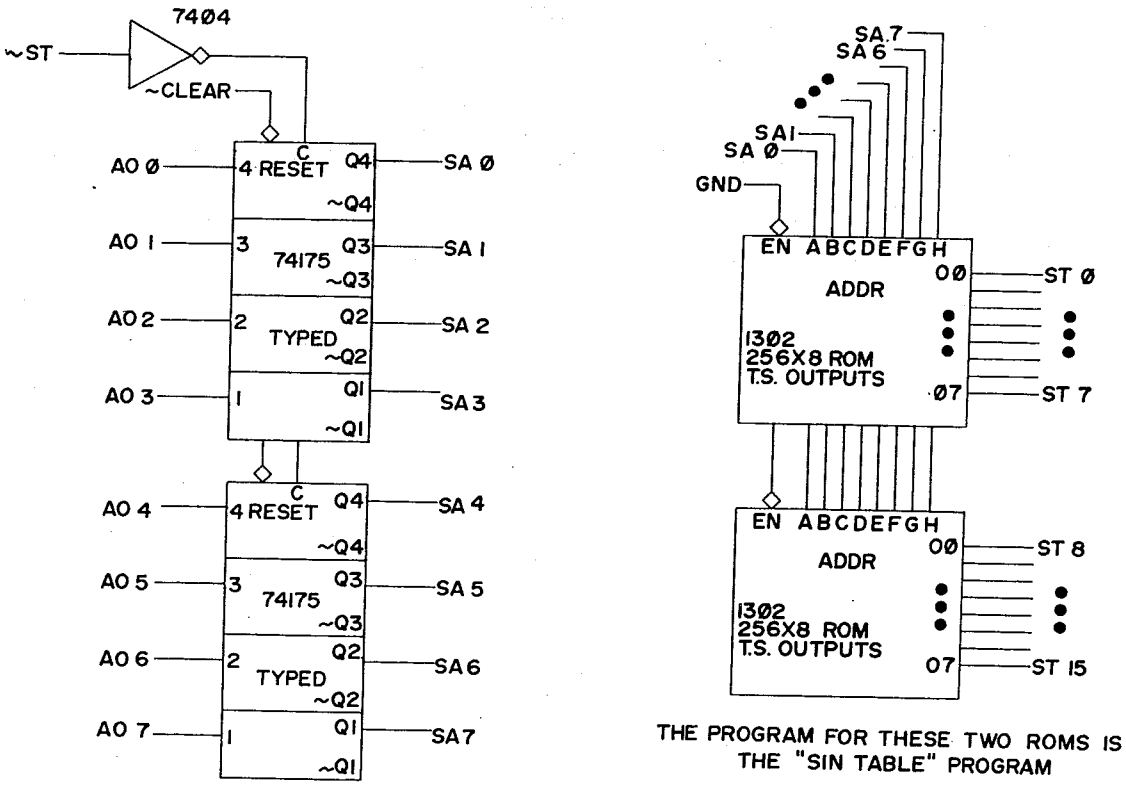

FIG. 18 is a sine table. It consists of a 256 — 16 bit word read only memory. The output of the read only memory is called ST0 through 15 and goes back into the input selector for the scratchpad memory. The address for the sine table comes out of the adder output AO0 through 7; that is, only the high order 8 bits are looked at and latched on the signal ST which is again generated from the latch select bits from the instruction word LS0 through 2. When ST occurs, the adder output is latched and produces internal signals which are SA0 through 7; that is, the sine address or sine angle. With these memories, it can take as long as a microsecond to get the data out so one microsecond later or roughly two instruction cycles, the sine is available for use.

The running program for the foregoing is shown below.

| INSTRUCTION MEMORY locations RUNNING program | | ISel,MA,WS,LS,RE,LOB,SSEL,NE | 10123456789012345 |
|---|---|---|---|
| 0 | pos1→AL1 | 0,0,0,3,1,0,0,0 | 0000000011001000 |
| 1 | fr1→AL2 | 0,1,0,4,1,0,0,0 | 0000100100001000 |
| 2 | AC→pos1, AO→ST | 0,0,1,5,0,0,0,1 | 0000001101000001 |
| 3 | I2→AL1 | 0,10,0,3,1,0,0,0 | 0100000011001000 |
| 4 | MO→t1→outbuf | 0,14,0,7,1,0,0,1 | 0110000111001001 |
| 5 | ST→t1→ML2 | 0,14,2,2,1,0,0,1 | 0110010010001001 |
| 6 | I2→ML1 | 0,10,0,1,1,0,0,0 | 0100000001001000 |
| 7 | env(00)→AL2 | 0,0,0,4,5,0,0,0 | 0000000100101000 |
| 10 | AO→I2 | 1,10,1,0,0,0,0,1 | 1100001000000001 |
| 11 | pos2→AL1 | 1,3,2,3,1,0,0,0 | 1001100011001000 |
| 12 | fr2→AL2 | 1,4,0,4,1,0,0,0 | 1010000100001000 |
| 13 | AO→pos2, AO→ST | 1,3,1,5,0,0,0,1 | 1001101101000001 |
| 14 | MO→t1 →ML2 | 1,14,0,2,1,0,0,1 | 1110000010001001 |
| 15 | fr108→ML1 | 1,2,0,1,1,0,0,0 | 1001000001001000 |
| 16 | pos2→AL1 | 1,3,0,3,1,0,0,0 | 1001100011001000 |
| 17 | C1→AL2 | 1,0,0,4,3,0,0,0 | 1000000100011000 |
| 20 | ST→t1, AO→ST | 1,14,2,5,0,0,0,1 | 1110010101000001 |
| 21 | I1→AL1 | 1,11,0,3,1,0,0,0 | 1100100011001000 |
| 22 | env(10)→AL2 | 1,0,0,4,5,0,0,0 | 1000000100101000 |
| 23 | MO→ti2 | 1,13,0,0,0,0,1,1 | 1101100000000011 |
| 24 | ST→t2→ML2 | 1,15,2,2,1,0,1,1 | 1110110010001011 |

-continued

| INSTRUCTION MEMORY locations RUNNING program | ISel,MA,WS,LS,RE,LOB,SSEL,NE | 10123456789012345 |
|---|---|---|
| 25 pos2(lob)→ML1 | 1,3,0,1,1,1,1,0 | 1001100001001110 |
| 26 AO→I1 | 1,11,1,0,0,0,1,1 | 1100101000000011 |
| 27 A→AL1 | 1,12,0,3,1,0,1,0 | 1101000011001010 |
| 30 env(11)→AL2 | 1,0,0,4,5,0,1,0 | 1000000100101010 |
| 31 AO→A | 0,12,1,0,0,0,0,0 | 0101001000000000 |
| 32 t1→AL2 | 0,14,0,4,1,0,0,0 | 0110000100001000 |
| 33 nop | 0 | 0 |
| 34 MO→t1→AL1 | 0,14,0,3,1,0,0,1 | 0110000011001001 |
| 35 AO→t1→ML2 | 0,14,1,2,1,0,0,1 | 0110001010001001 |
| 36 I1→ML1 | 0,11,0,1,1,0,0,0 | 0100100001001000 |
| 37 nop | 0 | 0 |
| 40 nop | 0 | 0 |
| 41 nop | 0 | 0 |
| 42 nop | 0 | 0 |
| 43 nop | 0 | 0 |
| 44 MO→t1→ML2 | 0,14,0,2,1,0,0,0 | 0110000010001000 |
| 45 fr2o8→ML1 | 0,5,0,1,1,0,0,0 | 0010100001001000 |
| 46 nop | 0 | 0 |
| 47 nop | 0 | 0 |
| 50 nop | 0 | 0 |
| 51 nop | 0 | 0 |
| 52 ti2→AL1 | 0,13,0,3,1,0,0,0 | 0101100011001000 |
| 53 MO→t1→AL2 | 0,14,0,4,1,0,0,1 | 0110000100001001 |
| 54 AO→ti2→AL2 | 0,13,1,4,1,0,0,1 | 0101101100001001 |
| 55 pos3→AL1 | 0,6,0,3,1,0,0,0 | 0011000011001000 |
| 56 AO→ti2, AO→ST | 0,13,1,5,0,0,0,1 | 0101101101000001 |
| 57 ti2→AL1 | 0,13,0,3,1,0,0,0 | 0101100011001000 |
| 60 C1→AL2 | 0,0,0,4,3,0,0,0 | 0000000100011000 |
| 61 ST→t1, AO→ST | 0,14,2,5,0,0,0,0 | 0110010101000000 |
| 62 nop | 0 | 0 |
| 63 ti2(lob)→ML2 | 0,13,0,2,1,1,0,0 | 0101100010001100 |
| 64 ST→t2→ML1 | 0,15,2,1,1,0,0,1 | 0110110001001001 |
| 65 pos3→AL2 | 0,6,0,4,1,0,0,0 | 0011000100001000 |
| 66 fr3→AL1 | 0,4,0,3,1,0,0,0 | 0010000011001000 |
| 67 AO→pos3 | 0,6,1,0,0,0,0,1 | 0011001000000001 |
| 70 nop | 0 | 0 |
| 71 nop | 0 | 0 |
| 72 MO→t2→AL1 | 0,15,0,3,1,0,0,1 | 0110100011001001 |
| 73 t→AL2 | 0,15,0,4,1,0,0,0 | 0110100100001000 |
| 74 AO→t1→ML2 | 0,14,1,2,1,0,0,1 | 0110001010001001 |
| 75 A→ML1 | 0,12,0,1,1,0,0,0 | 0101000001001000 |
| 76 →EL | 0,0,0,6,0,0,0,0 | 0000000110000000 |
| 77 nop | 0 | 0 |

In the above running program the left hand column has the actual program counter number in octal form. The second column is a shorthand notation for describing where data is flowing. In general, the adder latches are AL1 and AL3, multiplier latches are ML1 and ML2, the sine table latches ST, the envelope memory is ENV. For the state of bits Isel and Ssel they are ENV (00, 01, 10, 11) to reflect the four possible states. For the writing back into the scratchpad memory there is either AO for adder output, MO for multiplier output, ST for sine table and FT for frequency table. This is, only in initialization, of course.

The program of TABLE I is repeatedly processed by the apparatus of FIG. 5. In so doing, the apparatus of FIG. 5 iteratively performs calculations which are an approximation of Equation (2). The instructions of TABLE I are stored in the instruction memory 41 of FIG. 5. The instructions are accessed in order, from Instruction 0 to Instruction 77, to complete one pass through TABLE I. After each pass through TABLE I, Instructions 0 through 77 are again accessed to complete a new pass through TABLE I.

The final calculation for each pass through TABLE I is set up by latching quantities into the input latches of multiplier 31. Those quantities are latched during Instructions 74 and 75. The product of those quantities, latched in the multiplier during Instructions 74 and 75, becomes available on the multiplier 31 output (MO) approximately five instruction cycles later. Five instruction cycles later, for any given pass through the TABLE I instructions, actually occurs in the next pass through TABLE I. In the next pass through TABLE I, Instruction 4 transfers the output from multiplier 31 to latches 33.

For each pass through TABLE I, a new value is gated into the output latches 33 in FIG. 5. The digital-to-analog converter 22 converts the data stored in latches 33 to an analog signal which in turn is converted to a musical sound in speaker 23.

The TABLE I instructions evaluate Equation (2) utilizing an interpolation technique for evaluating the sine terms in Equation (2). Also the instructions of TABLE I employ scaling factors for the modulation indexes. The interpolation technique, the scaling factors and the equations actually iterated by the TABLE I instructions will now be described.

Equation (2) includes three sine terms. In order to accurately evaluate the sine terms with a comparatively small sine table (256-word sine memory 34 of FIG. 5), two of the three sine values in Equation (2) are evaluated using an interpolation technique. Evaluation of the third sine term ($\sin\omega_{m2}t$), however, does not employ the interpolation technique when this term represents the grit function for producing inharmonic partials which do not require the greater accuracy achieved by interpolation.

The interpolation involves separately utilizing the high-order bits and the low-order bits of angles.

As previously indicated, the sine memory 34 in FIG. 5 is addressed by only the eight high-order bits of angles from the adder 32. The angles in the apparatus of FIG. 5, and particularly those output from adder 32, are defined by 16-bit binary numbers. While the sine memory 34 only receives the high-order eight bits, the interpolation technique employs the low-order eight bits to form a more accurate evaluation of the sine term.

In order to do the interpolation, an angle such as the $\omega_{m1}t$ modulating frequency is defined by two parts. The angle $\omega_{m1}t$ is equal to the high-order bits of $\omega_{m1}t$ (hereinafter hob: $\omega_{m1}t$) plus the low-order bits of $\omega_{m1}t$ (hereinafter lob: $\omega_{m1}t$). The term $\sin(\omega_{m1}t)$ is given therefore by the following Equation (3).

$$\sin(\omega_{m1}t) = \sin(\text{hob: } \omega_{m1}t + \text{lob: } \omega_{m1}t) \quad (3)$$

Using the sum of angles formula, Equation (3) is expanded to the following Equation (4).

$$\sin(\text{hob: } \omega_{m1}t + \text{lob: } \omega_{m1}t) = \sin(\text{hob: } \omega_{m1}t)\cos(\text{lob: } \omega_{m1}t) + \sin(\text{lob: } \omega_{m1}t)\cos(\text{hob: } \omega_{m1}t) \quad (4)$$

In Equation (4), (hob: $\omega_{m1}t$) is much, much greater (256 times greater) than (lob: $\omega_{m1}t$). Under these conditions, the term cos(lob: $\omega_{m1}t$) is approximately equal to unity and the term sin(lob: $\omega_{m1}t$) is approximately equal to (lob:$\omega_{m1}t$) itself. Using those approximations, the value of the $\sin(\omega_{m1}t)$ is given by the following Equation (5).

$$\sin(\omega_{m1}t) = \sin(\text{hob: } \omega_{m1}t) + (\text{lob: } \omega_{m1}t)\cos(\text{hob: } \omega_{m1}t) \quad (5)$$

By using Equation (5), the accuracy with which the sine terms are calculated is as if sine memory 34 in FIG. 5 had 4,000 locations rather than just 256 locations. Of course, the interpolation in accordance with Equation (5) can be avoided, merely by employing a larger sine memory 34 or by accepting less accurate results with an attendant deterioration in quality of the sound produced.

In the TABLE I evaluation of Equation (2), the modulation indexes $I1(t)$ and $I2(t)$ are divided by a constant 8 to form modulation indexes I1 and I2, respectively. In order to restore the modulation indexes to their full values, the modulation indexes I1 and I2 in TABLE I are each multiplied by a scaling factor which cancels the factor of 8 division. The scaling factors for the modulation indexes are selected as 8 times ($\Delta\omega_{m1}t$) for I1 and as 8 times ($\Delta\omega_{m2}t$) for I2.

In the evaluation of Equation (2), the indexes $I1(t)$ and $I2(t)$ are given by Equations (6) and (7).

$$I1(t) = (I1)\ (8\Delta\omega_{m1}t) \quad (6)$$

$$I2(t) = (I2)\ (8\Delta\omega_{m2}t) \quad (7)$$

The program of TABLE I treats the amplitude A of Equation (2) as a function of time so that A becomes $A(t)$.

Using $A(t)$ and the modulation indexes of Equations (6) and (7), Equation (2) becomes Equation (8) as follows.

$$e = A(t)\sin[\omega_c t + (I1)\ (8\Delta\omega_{m1}t)\sin(\omega_{m1}t) + (I2)\ (8\Delta\omega_{m1}t)\sin\omega_{m2}t] \quad (8)$$

Note that the form of Equation (8) is like that of a differential equation in that it includes the $\Delta\omega_{m1}t$ and $\Delta\omega_{m2}t$ terms. The incremental evaluation by TABLE I is like an integration which transforms differential equations like Equation (8) to equations like Equation (2).

In Equation (8), the overall angle for the first sine term is designated as X and therefore Equation (8) becomes the following Equation (9).

$$e + A(t)\sin[X] \quad (9)$$

In Equation (9), the approximation like that employed in Equation (5) is also employed to form the Equation (10) as follows:

$$e = A(t)\ [\sin(\text{hob:}X) + (\text{lob:}X)\cos(\text{hob:}X)] \quad (10)$$

In Equation (8) the approximation of Equation (5) is also employed in connection with evaluating the $\sin(\omega_{m1}t)$ term. Utilizing Equation (5) and Equation (8), the value for X in Equation (10) is given by the following Equation (11).

$$X = [\omega_c t + (8\Delta\omega_{m1}t)\ (I1)\ [\sin(\text{hob:}\omega_{m1}t) + (\text{lob:}\omega_{m1}t)\cos(\text{hob:}\omega_{m1}t)] + (8\Delta\omega_{m2}t)(I2)\sin(\text{hob:}\omega_{m2}t)] \quad (11)$$

The program of Table I evaluates Equations (10) and (11) at many different incremental values of angles and amplitudes. For each pass through TABLE I, new incremental values are added to the angles and amplitudes and Equations (10) and (11) are evaluated with the new values to form an approximation of Equation (2). For each pass through TABLE I constant incremental values $\Delta\omega_c t$, $\Delta\omega_{m1} t$, and $\Delta\omega_{m2} t$ are added to each of the angles, $\omega_c t$, $\omega_{m1} t$, and $\omega_{m2} t$, respectively. In a similar manner, each of the amplitudes $A(t)$, I1, and I2 are added to time-varying incremental values $\Delta A$, $\Delta I1$ and $\Delta I2$, respectively, for each pass through TABLE I. After the incremental values are added to the angles and the amplitudes in Equations (10) and (11), the addition, multiplication and sine functions of Equations (10) and (11) are performed as now described in connection with the TABLE I program.

In TABLE I, the instructions are numbered in accordance with their octal address in the memory 41 of FIG. 5. The instructions are sequentially fetched from the memory 41 and executed by the FIG. 5 apparatus.

In Instruction 0, the contents from the pos1 of the scratch pad memory 26 are gated to the AL1 latch of the adder 32. The location pos1 in the scratch pad memory stores the accumulated value for the angle $\omega_{m2} t$. The old $\omega_{m2} t$ value from pos1 has added to it an incremental angle $\Delta\omega_{m2} t$ to form a new $\omega_{m2} t$ value which is stored back into pos1 as hereafter explained.

In Instruction 1, the contents of the *fr*1 location of the scratch pad memory 26 are gated to the AL2 latch of the adder 32. The *fr*1 location of the scratch pad memory stores the incremental angle $\Delta\omega_{m2} t$ which is added to the accumulated value of the modulation frequency $\omega_{m2} t$ by adder 32.

In Instruction 2, the new value of $\omega_{m2} t$ resulting from the addition set up in Instruction 0 and 1 at the output (AO) from adder 32 is stored into pos1 location of the scratch pad memory 26. Also, the eight high-order bits of the results of the addition from adder 32 are input to the sine memory 34 (ST) of FIG. 5. Memory 34 is therefore addressed to provide a value equal to sin(hob:$\omega_{m2} t$) which is the last factor in the last term of Equation (11).

In Instruction 3, the accumulated value of I2 of the second modulation index is gated from the I2 location of scratch pad memory 26 to the AL1 latch of adder 32.

In Instruction 4, the output (MO) from the multiplier 31 in FIG. 5 is gated to the output buffer latches 33 through the *t*1 location of the scratch pad memory 26. The output (MO) from multiplier 31 is the product formed by multiplying the quantities stored in the multiplier latches ML1 and ML2 in Instructions 74 and 75 of a prior pass through TABLE I. After completion of Instruction 77 for any particular pass through TABLE I, Instruction 0 is again accessed and a new pass through the TABLE I instructions is carried out. For each pass through the instructions of TABLE I, the multiplier output (MO) is stored in latches 33 by Instruction 4. The output stored by Instruction 4 is an elevation of Equation (10) which was determined by the previous pass through TABLE I.

In Instruction 5, the output (ST) from the sine memory 34, is stored first in the *t*1 location of the scratch pad memory 26 and then in the ML2 input latch (MPL2) of multiplier 31. The value stored in the ML2 latch is sin(hob:$\omega_{m2} t$) which is the last factor of the last term of Equation (11).

In Instruction 6, the accumulated value of the second modulation index I2 is gated from the I2 location of scratch pad memory 26 to the ML1 input latch (MPL1) of multiplier 31.

In Instruction 7, the $\Delta I2$ value to be added to the accumulated value of the second modulating index is accessed from the (00) locations of the envelope memory 27 and stored in the AL2 latch location of adder 32. Depending upon what has been stored in memory 27, the value of $\Delta I2$ can change for each pass through TABLE I. In any case I2 is time varying in accordance with the present invention.

In Instruction 10, the $\Delta I2$ value from Instruction 7 and the accumulated value of I2 from Instruction 3 have been added and the sum is stored as a new I2 value into the I2 location of scratch pad memory 26. The contents of the I2 location are now ready for use during the next pass through the TABLE I program.

In Instruction 11, the accumulated value of the $\omega_{m1} t$ angle is read out from pos2 of the scratch pad memory to the AL1 latch of the adder 32.

In Instruction 12, the $\Delta\omega_{m1} t$ incremental angle is read out from the *fr*2 location of the scratch pad memory to the AL2 adder latch.

In Instruction 13, the sum from the addition of the latched values in Instructions 11 and 12 is the new accumulated value of the angle $\omega_{m1} t$. That new value is stored back into location pos2 of the scratch pad memory. Also the higher order bits of the sum output from the adder are utilized to address the sine memory.

In Instruction 14, the product result of the multiplication initiated by the values latched in the multiplier in Instructions 5 and 6 is available and stored in the *t*1 location of the scratch pad memory and then into the ML2 latch of the multiplier 31. The product formed and stored in the ML2 latch is the righthand two factors of the last term in Equation (11), that is, (12)sin(hob:$\omega_{m2} t$).

In Instruction 18, the $8\Delta\omega_{m2} t$ scaling factor is read out from the fr108 location of the scratch pad memory and stored in the multiplier latch ML1. The multiplier 31 commences multiplication of the values latched in Instructions 14 and 15 and the product result appears later at the time of Instruction 23.

In Instruction 16, the accumulated value of the $\omega_{m1} t$ angle is transferred to the AL1 adder latch.

In Instruction 17, a constant is read out from the store 29 of FIG. 5 and stored into the AL2 latch of adder 32. The constant is a binary representation of an odd number multiple of $\pi/2$ (e.g., $3\pi/2$) which when added to a sine angle shifts a sine function to a cosine function.

In Instruction 20, the sum result of the addition of the values latched in Instructions 16 and 17 is available and input to the sine memory 34 of FIG. 5. At the same time, the previous output from the sine table addressing in Instruction 13 is stored in the *t*1 location of the scratch pad memory. The values stored in *t*1 is sin(hob:$\omega_{m1} t$) which is a factor in the second term of the Equation (11).

In Instruction 21, the accumulated value of the modulation index I1 is read out from the I1 location of the scratch pad memory and stored in the adder latch AL1.

In Instruction 22, the incremental value $\Delta I1$ of the first modulation index is read out from the (10) locations of the envelope memory 27 and stored in the AL2 latch of the adder 32. Depending upon what has been stored in memory 27, the value of $\Delta I1$ can change for each pass through TABLE I. In any case, I1 is time varying.

In Instruction 23, the product result of the multiplication initiated in Instructions 14 and 15 is available and is stored in the *ti*2 location of the scratch pad memory 26. The product stored in the *ti*2 location is the last term of Equation (11).

In Instruction 24, the output from the sine memory 34, as addressed in the Instruction 20, is transferred through the *t*2 location of the scratch pad memory to the multiplier latch ML2. The value stored in latch ML2 is $\cos(\text{hob}:\omega_{m1}t)$ which is a factor in the second term of Equation (11).

In Instruction 25, the lower order eight bits of the accumulated value of the angle $\omega_{m1}t$ are read out from pos2 of the scratch pad memory and stored in the multiplier latch ML1. Multiplier 31 commences multiplication of the values latched in Instructions 24 and 25 and the product becomes available during Instruction 34.

In Instruction 26, the addition of the quantities latched in Instructions 21 and 22 forms a sum which is the new accumulated value for the modulation index I1 and which is stored in the I1 location of the scratch pad memory.

In Instruction 27, the accumulated value of the amplitude envelope A is transferred from the A location of the scratch pad memory 26 to the adder latch AL.

In Instruction 30, the incremental value ΔA is read out from locations (11) of the envelope memory 27 and latched in the adder latch AL2.

In Instruction 31, the new accumulated value A of the amplitude resulting from addition of the values latched in Instructions 27 and 30 is stored into the A location of the scratch pad memory.

In Instruction 32, the contents of the *t*1 location of the scratch pad memory are latched into the adder latch AL2. The quantity in latch AL2 is the one stored previously into the *t*1 location in Instruction 20, that is, $\sin(\text{hob}:\omega_{m1}t)$.

In Instruction 33, no new operation is initiated.

In Instruction 34, the results of the multiplication of quantities latched in Instructions 24 and 25 is available and the product is stored through the *t*1 location of the scratch pad memory into the adder latch AL1. The product stored in AL1 is term $(\text{lob}:\omega_{m1}t)\cos(\text{hob}:\omega_{m1}t)$ of Equation (11).

In Instruction 35, the sum result of the addition of the values latched into the adder in Instructions 32 and 34 is stored by way of the scratch pad location *t*1 into the multiplier latch ML2. The contents of latch ML2 are $\sin(\text{hob}:\omega_{m1}t) + (\text{lob}:\omega_{m1}t)\cos(\text{hob}:\omega_{m1}t)$.

In Instruction 36, the accumulated value I1 of the first modulation index is read out from the I1 location of the scratch pad memory and stored into the multiplier ML1 latch. The multiplication commences after Instruction 36 and the product is available during Instruction 44.

In Instructions 37 through 43, no new operations are initiated.

In Instruction 44, the product of I1 times the quantity latched in Instruction 35 is stored into the multiplier latch ML2. This product is $(\text{I1})[\sin(\text{hob}:\omega_{m1}t) + (\text{lob}:\omega_{m1}t)\cos(\text{hob}:\omega_{m1}t)]$ which is a part of Equation (11).

In Instruction 45, the scaling factor $(8\Delta\omega_{m1}t)$ is read out from the scratch pad location fr208 and stored in the multiplier latch ML1. With Instruction 45, the multiplication commences and the product is available in Instruction 53.

In Instructions 46 through 51, no new operations are initiated.

In Instruction 52, the contents from the scratch pad memory location *ti*2 are stored into the adder latch AL. Adder latch AL1 contains the quantity which was stored in the *t*location in Instruction 23, and which is the last term of Equation (11).

In Instruction 53, the product resulting from multiplication of the quantities latched in the multiplier in Instructions 44 and 45 is available and is transferred through the *t*1 scratch pad location to the adder latch AL2. The quantities now in the adder latch AL2 is the second term of Equation (11), namely, $(8\Delta\omega_{m1}t)(\text{I1})[-(\sin(\text{hob}:\omega_{m1}t) + (\text{lob}:\omega_{m1}t)\cos(\text{hob}:\omega_{m1}t)]$.

In Instruction 54, the quantities latched in Instructions 52 and 53 are added and the sum result is stored in location *ti*2 of the scratch pad memory and then transferred to the AL2 latch of the adder. The quantity in latch AL2 is the sum of the last two terms of Equation (11).

In Instruction 55, the accumulated value $\omega_c t$ for the carrier frequency angle is read out from pos3 of the scratch pad memory and stored in the adder latch AL1.

In Instruction 56, the values latched in Instructions 54 and 55 are added and the sum result is stored in the *ti*2 location of the scratch pad memory. The quantity in the location *ti*2 is now the value X as defined by Equation (11). The high-order bits of X from the adder output in Instruction 56 are input to address the sine memory.

In Instruction 57, the value of X from the *ti*2 scratch pad memory location is latched into the adder latch AL1.

In Instruction 60, a constant C1 is accessed from the binary constant store 29 and stored in adder latch AL2.

In Instruction 61, the output from the sine memory sin(hob:X), which is a factor in Equation (10), is stored in the scratch pad memory location *t*1. At the same time, the output from the adder, which is the sum of the values latched in Instructions 57 and 60, is input to the sine memory. The addition of the quantities latched in Instructions 57 and 60 converts the sine function to a cosine function, namely, to cos(hob:X).

In Instruction 62, no new operation is initiated.

In Instruction 63, the eight low-order bits of the *ti*2 location of the scratch pad memory are input to the multiplier latch ML2 so that ML2 stores (lob:X).

In Instruction 64, the output from the sine table addressed in Instruction 61, is transferred to the *t*2 location of the scratch pad memory and then to the multiplier latch ML1 so that ML1 stores cos(hob:X).

Multiplication commences and the product of the values latched in Instructions 63 and 64 is available in Instruction 72.

In Instruction 65, the accumulated value $\omega_c t$ of the carrier angle is transferred from the scratch pad memory location pos3 to the adder latch AL2.

In Instruction 66, the incremental angle $\Delta\omega_c t$ is read out from the scratch pad memory location *fr*3 and stored in the adder latch AL1.

In Instruction 67, the values latched in Instructions 65 and 66 are added to form the new accumulated sum $\omega_c t$ which is stored into the scratch pad memory location pos3.

In Instructions 70 and 71, no new operations are initiated.

In Instruction 72, the product of the quantities latched in Instructions 63 and 64 is stored in the $t2$ location of the scratch pad memory and then into the adder latch AL1. The quantity in latch AL1 is the right-hand term of Equation (10), namely, (lob:X)cos(-hob:X).

In Instruction 73, the contents of the $t1$ scratch pad memory location are stored in the adder latch AL2. Latch AL2 at this time stores the quantity sin(hob:X) which is the lefthand term in Equation (10) and which was stored in $t1$ in Instruction 61.

In Instruction 74, the sum of the quantities latched in Instructions 72 and 73 is available on the output from the adder and is stored into scratch pad memory location $t1$ and from there into the multiplier latch ML2. The quantity in latch ML2 is [sin(hob:X) + (lob:X-)cos(hob:X)].

In Instruction 75, the amplitude value A from the A location of the scratch pad memory is latched into the multiplier latch ML1 and starts the multiplication of the quantities latched in Instructions 74 and 75. The multiplication started by Instruction 75 is not complete until at least five instruction cycles later. When complete, the final product A($t$)[sin(hob:X) + (lob:X-)cos(hob:X)] is formed which equals the value $e$ of Equation (10). The final product for one pass through TABLE I becomes available in Instruction 4 of the next pass through TABLE I.

I claim:

1. A method of synthesizing a musical sound composed of a plurality of component frequencies and characterized by a time-varying amplitude envelope having a time-varying attack portion, a substantialy steadystate portion and a time-varying decay portion, the steps comprising, generating a signal $\omega_c$ to define a carrier frequency in the audio range, generating a signal $\omega_m$ to define a modulation frequency in the audio range, generating a signal I($t$) to define a time-varying modulation index, frequency modulating $\omega_c$ with $\omega_m$ to form a frequency modulated wave defined by $e = A\sin[\omega_c t + I(t)\sin\omega_m t]$ where $e$ defines the instantaneous amplitude of said wave, A defines the peak amplitude of said wave, and $[\omega_c t + I(t)\sin\omega_m t]$ defines the frequency spectrum of said wave wherein the frequency spectrum of said wave changes as a function of the modulation index I($t$) to form a representation of said sound.

2. A method as in claim 1 including the step of varying I($t$) as a function of the attack portion of said amplitude envelope.

3. In a digital apparatus having storage means for storing signals including an audio-range carrier frequency signal $\omega_c$, including an audio-range modulation frequency signal $\omega_m$, including a time-varying modulation index signal I($t$), and including an output amplitude signal A; having waveform means for providing waveform signals as a function of input angles; and having arithmetic means for arithmetically combining signals; a method of synthesizing a musical sound comprising the steps of, accessing from said storage means, periodically with time $t$, the signals $\omega_m$, $\omega_c$, I($t$) and A, transferring said signal $\omega_m$ as an input angle to said waveform means to provide periodically a modulation waveform signal, multiplying, in said arithmetic means, said modulation waveform signal and a value of said signal I($t$) to form periodically a modulation component signal, adding, in said arithmetic means, said modulation component signal and the signal $\omega_c$ to obtain periodically an output angle signal, transferring said output angle signal to said waveform means to obtain periodically an output waveform signal, multiplying, in said arithmetic means, said output waveform signal by said signal A to provide an output signal to produce said musical sound.

4. An apparatus for electrically synthesizing musical sound comprising, store means for storing signals proportional to amplitudes A of an output signal $e$, for storing signals proportional to audio-range carrier frequencies $\omega_c$, for storing signals proportional to modulation frequencies $\omega_m$, for storing signals proportional to amplitude modulation indexes I($t$) where I($t$) varies as a function of time $t$, accessing means for accessing said signals, periodically with time $t$, from said store means, processing means for processing said signals accessed from said store means to form said output signal equal to $A\sin[\omega_c t + I(t)\sin\omega_m t]$, audio transducer means responsive to said output signal for providing an audio signal output representing said musical sound.

5. An apparatus for synthesizing musical sound composed of a plurality of frequency components and characterized by a time-varying amplitude envelope including a time-varying attack portion, a substantially steady-state portion and a time-varying decay portion, said apparatus comprising, sine wave means for producing signals proportional to the sine of input angles, an adder, a multiplier, a temporary store, frequency store means for storing values of audio-range frequency signals including carrier frequency signals $\omega_c t$ and modulation frequency signals $\omega_m t$, amplitude store means for storing amplitude signals including time-varying amplitude modulation signals I($t$) and output amplitude signals A, means for connecting periodically a modulation frequency signal $\omega_m t$ as an input angle to said sine wave means to produce signal $\sin\omega_m t$ in said temporary store, means for connecting periodically said signal $\sin\omega_m t$ to said multiplier and means for connecting periodically time-varying values of said signal I($t$) to said multiplier to form periodically a product signal I($t$) $\sin\omega_m t$ in said temporary store, means for connecting periodically said signal I($t$) $\sin\omega_m t$ to said adder means and means for connecting periodically a carrier frequency signal $\omega_c t$ to said adder to form periodically a sum signal $[\omega_c t + I(t)\sin\omega_m t]$ in said temporary store, means for connecting periodically said signal $[\omega_c t + I(t)\sin\omega_m t]$ as an input angle to said sine wave means whereby said sine wave means periodically provides a signal $\sin[\omega_c t + I(t)\sin\omega_m t]$ in said temporary store, means for connecting periodically said signal $\sin[\omega_c t + I(t)\sin\omega_m t]$ to said multiplier and means for connecting periodically an amplitude value A to said multiplier to provide periodically an output signal A sin $[\omega_c t + I(t) \sin \omega_m t]$ in said temporary store, audio transducer means responsive to said output signal for providing an audio signal representing said musical sound.

6. The apparatus of claim 5, wherein said frequency store means includes means for storing said signals $\omega_m t$ and $\omega_c t$ such that $\omega_c$ is an integral multiple of $\omega_m$ whereby said output signal has a frequency spectrum including only odd harmonics.

7. The apparatus of claim 6 wherein said frequency store means includes means for storing said signals $\omega_m t$ and $\omega_c t$ such that the ratio $\omega_c/\omega_m$ is equal to 2/1.

8. The apparatus of claim 5 wherein said amplitude store means includes means for storing said modulation index signal $I(t)$ directly proportional to said attack portion of said amplitude envelope and said frequency store means includes means for storing the signals $\omega_c t$ and $\omega_m t$ such that the ratio $\omega_c/\omega_m$ is equal to $\omega_c/1$ whereby the frequency spectrum of said output signal includes both odd and even harmonics for producing musical sound with the timbrel quality of brass instruments.

9. The apparatus of claim 8 where said means for storing the signals $\omega_c t$ and $\omega_m t$ stores values such that $\omega_c/\omega_m$ is equal to 1/1.

10. The apparatus of claim 5 in which said frequency store means includes means for storing $\omega_c t$ and $\omega_m t$ such that the ratio of $\omega_c/\omega_m$ is equal to an irrational number whereby the frequency spectrum of said output signal includes inharmonic frequencies.

11. The apparatus of claim 5 wherein said frequency store means includes means for storing the frequency signals $\omega_c t$ equals to $\omega_{c1} t + \omega_{c2} t$ where $\omega_{c1}$ and $\omega_{c2}$ are unequal frequencies.

12. The apparatus of claim 11 where said frequency store means store $\omega_{c1} t$, $\omega_{c2} t$ and $\omega_m$ such that the ratio $\omega_{c2}/\omega_m$ is equal to 7/1 and such that the ratio $\omega_{c1}/\omega_m$ is equal to 1/1.

13. The apparatus of claim 5 wherein said frequency store means includes means for storing said frequency signals $\omega_m t$ as first frequency signals $\omega_{m1} t$ and second frequency signals $\omega_{m2} t$, wherein said amplitude store means includes means for storing said modulation signals $I(t)$ as first amplitude modulation signals $I_1(t)$ and as second amplitude modulation signals $I_2(t)$, whereby said output signal is Asin $[\omega_c t + I_1(t) \sin \omega_{m1} t + I_2(t) \sin \omega_{m2} t]$.

14. The apparatus of claim 5 wherein said amplitude store means includes means for storing said output amplitude signals A as a function of said time-varying amplitude envelope.

* * * * *